US010372071B2

(12) United States Patent
Minato

(10) Patent No.: US 10,372,071 B2
(45) Date of Patent: Aug. 6, 2019

(54) IMAGE FORMING APPARATUS

(71) Applicant: CANON KABUSHIKI KAISHA, Tokyo (JP)

(72) Inventor: Yusuke Minato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/681,749

(22) Filed: Aug. 21, 2017

(65) Prior Publication Data

US 2018/0059602 A1 Mar. 1, 2018

(30) Foreign Application Priority Data

Aug. 30, 2016 (JP) ..... 2016-168561
Jun. 23, 2017 (JP) ..... 2017-123737

(51) Int. Cl.
*G03G 15/16* (2006.01)
*G03G 15/00* (2006.01)

(52) U.S. Cl.
CPC ..... *G03G 15/5058* (2013.01); *G03G 15/162* (2013.01); *G03G 15/1605* (2013.01); *G03G 15/161* (2013.01); *G03G 15/168* (2013.01); *G03G 15/1675* (2013.01); *G03G 2215/00042* (2013.01); *G03G 2215/00059* (2013.01); *G03G 2215/0177* (2013.01)

(58) Field of Classification Search
CPC . B41J 2/385; B41J 2/0057; B41J 2/005; B41J 2002/012; G03G 15/16; G03G 15/0225; G03G 15/168; G03G 15/161; G03G 15/162; G03G 2215/00531; G03G 2221/0005; G03G 2221/0073
See application file for complete search history.

(56) References Cited

U.S. PATENT DOCUMENTS 8,670,687 B2 3/2014 Namba
8,725,030 B2 5/2014 Okano et al.
2012/0224882 A1* 9/2012 Namba ..... G03G 15/0131 399/101
2012/0224883 A1* 9/2012 Okano ..... G03G 21/169 399/101

(Continued)

FOREIGN PATENT DOCUMENTS

GB 1552483 A 9/1979
JP 1552483 * 10/1976

(Continued)

OTHER PUBLICATIONS

Search Report dated Sep. 12, 2017, in International Application No. PCT/JP2017/025287.

*Primary Examiner* — Scott A Richmond
(74) *Attorney, Agent, or Firm* — Venable LLP

(57) ABSTRACT

An image forming apparatus includes an image bearing member, a transfer roller, a power feeding rotary member, and a controller. The controller is configured to execute the cleaning mode such that a period in which the cleaning mode is executed comprises a first application period during which a reverse polarity bias having a polarity reverse to that of the transfer bias is continuously applied to the power feeding rotary member, and a second application period during which a same polarity bias having a same polarity with that of the transfer bias is continuously applied to the power feeding rotary member.

33 Claims, 9 Drawing Sheets

(56) References Cited

U.S. PATENT DOCUMENTS

| | | | | |
|---|---|---|---|---|
| 2014/0016956 | A1* | 1/2014 | Terasaki ..... | G03G 15/1675 399/66 |
| 2016/0124353 | A1 | 5/2016 | Nakaegawa | |

FOREIGN PATENT DOCUMENTS

| | | | |
|---|---|---|---|
| JP | S52-045344 | A | 4/1977 |
| JP | S52-045344 | A | 4/1997 |
| JP | 2005-316200 | A | 11/2005 |
| JP | 2012-181344 | A | 9/2012 |
| JP | 2012-194539 | A | 10/2012 |
| JP | 2013-117628 | A | 6/2013 |
| JP | 2013-228677 | A | 11/2013 |
| JP | 2016-075768 | A | 5/2016 |
| JP | 2016-090820 | A | 5/2016 |

* cited by examiner

IMAGE FORMING APPARATUS

BACKGROUND OF THE INVENTION

Field of the Invention

The present invention relates to an image forming apparatus such as a copier, a printer, a facsimile machine, a multi-function printer having multiple functions of these devices.

Description of the Related Art

Hitherto, there has been known an image forming apparatus of an intermediate transfer type configured to primarily transfer a toner image formed on a photosensitive drum to an intermediate transfer belt serving as an image bearing member and to secondarily transfer the toner image from the intermediate transfer belt to a recording medium. A transfer roller, i.e., a secondary transfer outer roller, configured to come into contact with an outer circumferential surface of the intermediate transfer belt is disposed in a secondary transfer portion where the toner image is secondarily transferred onto the recording medium and where the secondary transfer is performed a transfer voltage applied to the transfer roller.

The transfer roller is provided with an elastic layer around a conductive shaft portion and conductivity is imparted to the elastic layer by a conducting agent such as an ion conducting agent dispersed in the elastic layer. Accordingly, if an application time of voltage applied to the transfer roller increases depending on its use, ion within the ion conducting agent is apt to be polarized so as to be biased to either one side of a roller surface side or a shaft portion side, resulting in an increase of electric resistance caused by the polarization. Then, in order to suppress the increase of the electric resistance caused by the polarization, Japanese Patent Application Laid-open No. 2005-316200 proposes an image forming apparatus configured such that voltage is applied from a power feeding roller serving as a power feeding rotary member being in contact with a surface of the transfer roller to the transfer roller and to transfer the toner image from the intermediate transfer belt to the recording medium.

However, in a case where toner adheres to the transfer roller from the intermediate transfer belt to the transfer roller concerning the transfer roller disclosed in Japanese Patent Application Laid-open No. 2005-316200, the toner may adhere also to the power feeding roller being in contact with the transfer roller. If the toner adheres on the power feeding roller, irregularity of electric current flowing from the power feeding roller to the transfer roller may occur. Still further, the toner adhering on the power feeding roller may adhere again to the transfer roller, possibly contaminating a back surface of the recording medium.

Accordingly, the present disclosure provides an image forming apparatus including the power feeding rotary member capable of restraining a defective image caused by the toner adhering on the power feeding rotary member.

SUMMARY OF THE INVENTION

According to one aspect of the present invention, an image forming apparatus including an image bearing member configured to bear a toner image, a transfer roller comprising a conductive shaft portion and an outer circumferential portion containing a conducting agent and being formed around the shaft portion, the transfer roller forming a transfer portion where the transfer roller is in contact with an outer surface of the image bearing member to transfer the toner image borne on the image bearing member onto a recording medium, a power feeding rotary member configured to rotate while in contact with the transfer roller to supply electric current to the transfer roller to transfer the toner image at the transfer portion, a power source configured to apply a transfer bias to the power feeding rotary member, and a controller configured to execute a cleaning mode of cleaning the power feeding rotary member by applying a bias from the power source to the power feeding rotary member to transfer toner adhering on the power feeding rotary member to the image bearing member through the transfer roller in a state that the transfer roller, the power feeding rotary member and the image bearing member are rotating while the transfer roller is in contact with the power feeding rotary member and the transfer roller is in contact with the image bearing member in forming no image. The controller is configured to execute the cleaning mode such that a period in which the cleaning mode is executed comprises a first application period during which a reverse polarity bias having a polarity reverse to that of the transfer bias is continuously applied to the power feeding rotary member, and a second application period during which a same polarity bias having a same polarity with that of the transfer bias is continuously applied to the power feeding rotary member.

Further features of the present invention will become apparent from the following description of exemplary embodiments with reference to the attached drawings.

DESCRIPTION OF THE EMBODIMENTS

First Embodiment

Figure 1:
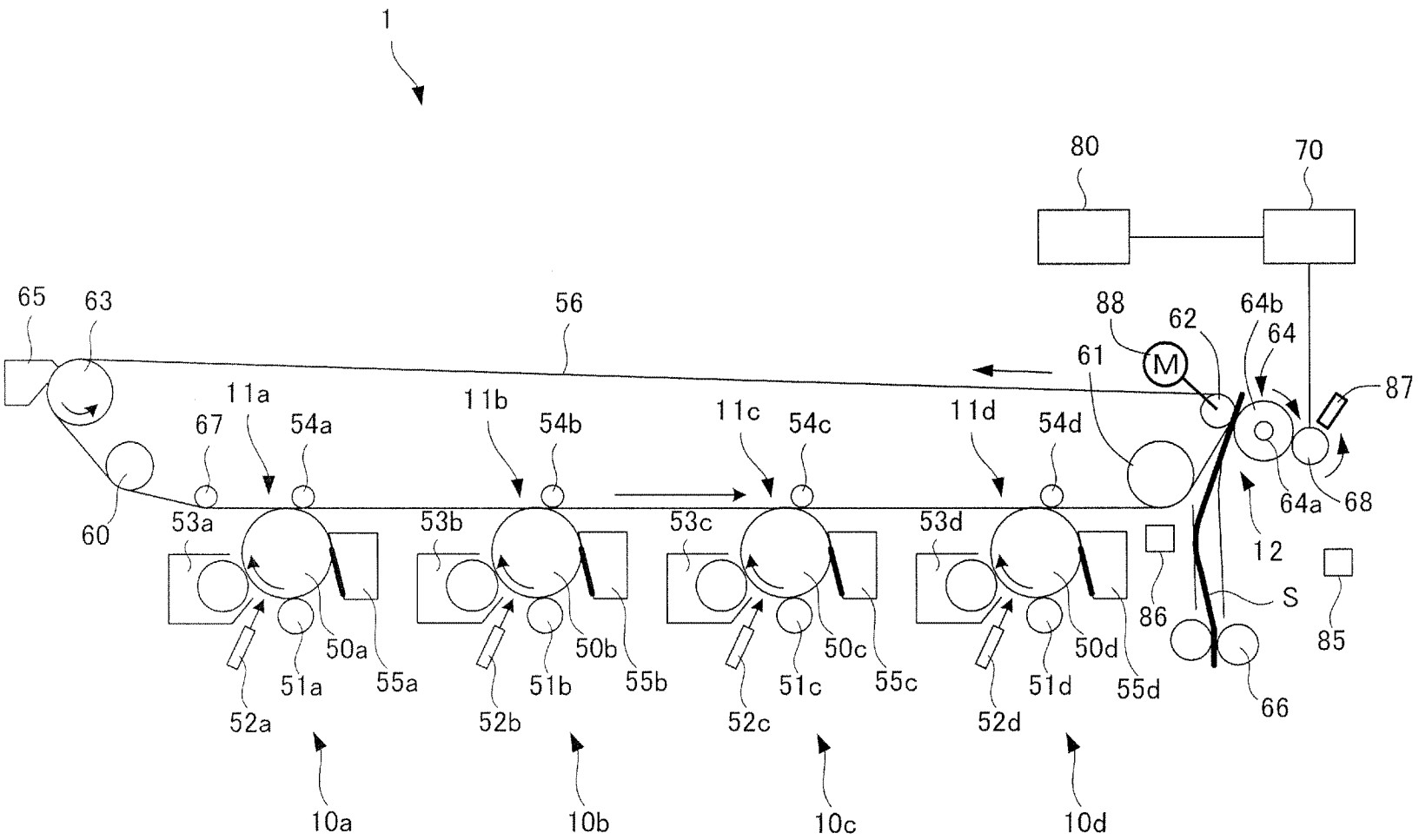
FIG. 1 is a section view schematically illustrating a configuration of an image forming apparatus of a first embodiment.

A first embodiment will be described below with reference to FIGS. 1 through 6 and FIGS. 8A through 8C. Firstly, a configuration of the image forming apparatus of the present embodiment will be described briefly with reference to FIG. 1.

Image Forming Apparatus

The image forming apparatus 1 of the present embodiment is a so-called tandem intermediate transfer type full-color printer in which a plurality of image forming portions 10*a*, 10*b*, 10*c*, and 10*d* are arrayed along a rotation direction, i.e., a moving direction, of an intermediate transfer belt 56. This type of image forming apparatus 1 is configured to electro-photographically form a full-color image on a sheet S which is one example of a recording medium corresponding to an image signal transmitted from an external device such as a personal computer or read from a document reading unit. It is noted that the sheet S is what a toner image is formed thereon, and examples thereof include a plain sheet, a synthetic resin sheet which is a substitute of the plain sheet, an overhead projector sheet and others.

The image forming apparatus 1 includes an apparatus body not illustrated and storing image forming portions 10*a*, 10*b*, 10*c*, and 10*d*. The image forming portions 10*a* through 10*d* include photosensitive drums 50*a*, 50*b*, 50*c*, and 50*d*, respectively, rotating in a direction of an arrow in FIG. 1. Surfaces of the photosensitive drums 50*a* through 50*d* are electrified respectively by electrifying rollers 51*a*, 51*b*, 51*c*, and 51*d*. Electrostatic latent images are then formed on the surfaces of the photosensitive drums 50*a* through 50*d* by exposure units 52*a*, 52*b*, 52*c* and 52*d* and are visualized as toner images by developing units 53*a*, 53*b*, 53*c* and 53*d* storing color component toners, respectively. In a case of the present embodiment, each of the development units 53*a* through 53*d* uses a two-component developer containing non-magnetic toner and magnetic carrier. A charging polarity of the toner is negative. However, the developing units 53*a* through 53*d* may be configured so as to use a one-component developer.

Primary transfer rollers 54*a*, 54*b*, 54*c*, and 54*d* are disposed at positions facing the photosensitive drums 50*a* through 50*d* and compose primary transfer portions 11*a*, 11*b*, 11*c*, and 11*d*, respectively. The respective color toner images formed on the photosensitive drums 50*a* through 50*d* are sequentially superimposed and are transferred onto the intermediate transfer belt 56 by a primary transfer bias applied to each of the primary transfer rollers 54*a* through 54*d*. After the primary transfer, toners left on the photosensitive drums 50*a* through 50*d* are removed by drum cleaning units 55*a*, 55*b*, 55*c*, and 55*d*. These image forming portions 10*a*, 10*b*, 10*c*, and 10*d* are disposed in order, from upstream of the intermediate transfer belt 56, of yellow (Y), magenta (M), cyan (C), and black (K).

Meanwhile, in synchronism with the toner image forming timing, the sheet S stored in a recording medium storage cassette not illustrated is conveyed from a registration roller 66 to a secondary transfer portion 12 serving as a transfer portion. Then, with a secondary transfer bias applied to the secondary transfer portion 12, the toner images superimposed and primarily transferred onto the intermediate transfer belt 56 are collectively transferred, i.e., secondarily transferred, onto the sheet S at the secondary transfer portion 12. A detailed configuration of the secondary transfer portion 12 will be described later. Toners and paper dust left on the intermediate transfer belt 56 without being transferred at the secondary transfer portion 12 are removed by a belt cleaning unit 65.

The belt cleaning unit 65 is disposed so as to face a tension roller 63 across the intermediate transfer belt 56 at a position downstream of the secondary transfer portion 12 and upstream of all of the primary transfer portions 11*a* through 11*d*. The belt cleaning unit 65 is configured such that a blade thereof comes into contact with the intermediate transfer belt 56 to clean a surface of the intermediate transfer belt 56.

Next, the sheet S is conveyed to a fixing unit not illustrated. The fixing unit heats up and pressurizes the toners on the sheet S such that the toners melt, are mixed and are fixed onto the sheet S as a full-color image. After that, the sheet S is discharged out of the apparatus body. Thus, a series of image forming process ends. The operations of the respective units are controlled by a controller 80.

Intermediate Transfer Belt

The intermediate transfer belt 56 serving as the image bearing member is a film-like endless belt and conveys, while bearing and rotating (moving), the toner images primarily transferred from the respective photosensitive drums 50*a* through 50*d*. For the intermediate transfer belt 56, resin such as polyimide or polyamide, an alloy thereof or various types of rubbers to which an appropriate amount of anti-static agent such as carbon black is added is used. The intermediate transfer belt 56 is formed so as to have surface resistivity of $1\times10^{9}$ to $5\times10^{13}\Omega/\square$ and a thickness of around 0.04 to 0.50 mm for example.

The intermediate transfer belt 56 is suspended around idler rollers 60, 61, and 67, the tension roller 63, and a secondary transfer inner roller 62. The tension roller 63 applies a tension around 3 to 12 kfg, i.e., about 29 to 118 N, for example to the intermediate transfer belt 56. The secondary transfer inner roller 62 is rotationally driven by a driving motor 88 serving as a driving portion and rotates the intermediate transfer belt 56 at a predetermined speed.

Primary Transfer Roller

The primary transfer rollers 54*a* through 54*d* are provided inside of the intermediate transfer belt 56 and are formed of metal rollers whose material is SUM (sulfur and sulfur-composite free-cutting steel), SUS (stainless steel) or the like. Voltage having a polarity reverse to a charged polarity of the toner, i.e., a primary transfer bias, is applied to the primary transfer rollers 54*a* through 54*d*. Thereby, a predetermined primary transfer contrast which is a potential difference between a surface potential of each of the photosensitive drums 50*a* through 50*d* and a potential of each of the primary transfer rollers 54*a* through 54*d* is formed. Because the predetermined primary transfer contrast is formed respectively in the primary transfer portions 11*a* through 11*d*, the toner images of the respective photosensitive drums 50*a* through 50*d* are sequentially and electrostatically adsorbed onto the intermediate transfer belt 56, resulting in the superimposed toner images. It is noted that the primary transfer rollers 54*a* through 54*d* are formed straight in a thrust direction and have a roller diameter of around 6 to 10 mm.

Secondary Transfer Portion

The secondary transfer portion 12 is formed by the secondary transfer outer roller 64 serving as the transfer roller being in contact with a toner image bearing surface, i.e., an outer surface, of the intermediate transfer belt 56. That is, the secondary transfer outer roller 64 forms the secondary transfer portion 12 where the toner image borne on the intermediate transfer belt 56 is transferred onto the sheet S together with the intermediate transfer belt 56. Specifically, the secondary transfer inner roller 62 is disposed so as to nip the intermediate transfer belt 56 with the secondary transfer outer roller 64, and a nip portion where the recording medium is nipped between the intermediate transfer belt 56 and the secondary transfer outer roller 64 is formed. Then, the toner images borne on the intermediate transfer belt 56 are transferred onto the sheet S, i.e., the recording medium, passing through the nip portion.

The secondary transfer outer roller 64 transfers the toner images from the intermediate transfer belt 56 onto the recording medium by receiving an electric current from a power feeding roller 68 serving as a power feeding rotary member. That is, the power feeding roller 68 comes into contact with the secondary transfer outer roller 64 at a position separated from the secondary transfer portion 12 in a circumferential direction of the power feeding roller 68 and supplies, while rotating, the electric current to the secondary transfer outer roller 64 to transfer the toner images at the secondary transfer portion 12. A high voltage power source 70 serving as a power source is connected with the power feeding roller 68 and can supply voltage, i.e., the transfer bias, to the power feeding roller 68. The high voltage power source 70 supplies the voltage to be used for the secondary transfer and various controls to the secondary transfer portion 12. A constant-voltage power supply is used for the high voltage power source 70 in the present embodiment.

Here, the secondary transfer inner roller 62 is configured by providing EPDM (ethylene propylene diene) rubber around a core metal. The secondary transfer inner roller 62 is formed so as to have a roller diameter of 20 mm and a rubber thickness of 0.5 mm, and hardness thereof is set to be 70 degrees (Ascar C) for example.

Meanwhile, the secondary transfer outer roller 64 includes a core metal 64*a* serving as a conductive shaft portion and an elastic layer 64*b* serving as an outer circumferential portion formed around the core metal 64*a* and containing a conducting agent. That is, the secondary transfer outer roller comprises the core metal 64*a* and the elastic layer 64*b* formed of rubber such as NBR (nitrile rubber) and the EPDM containing the conducting agent such as metal complex and carbon around the core metal 64*a*. The secondary transfer outer roller 64 is formed so as to have a roller diameter of 24 mm and such that a thickness of the elastic layer (sponge layer) 64*b* is 6 mm.

The power feeding roller 68 is disposed so as to come into contact with the secondary transfer outer roller 64 at a power feeding nip portion N (see FIG. 4A) located on a side opposite to the secondary transfer inner roller 62. Specifically, the power feeding roller 68 is disposed such that the power feeding nip portion N where the power feeding roller 68 and the secondary transfer outer roller 64 come into contact with each other is located at a position deviated from a position where the secondary transfer outer roller 64 is in contact with the intermediate transfer belt 56 by about 180 degrees in a rotation direction of the secondary transfer outer roller 64. It is noted that the position of the power feeding nip portion N may be located at another position as long as such position is different from the position where the secondary transfer outer roller 64 comes into contact with the intermediate transfer belt 56.

Still further, both ends in a direction of an axis of rotation of the power feeding roller 68 are pressurized to the side of the secondary transfer outer roller 64 by springs not illustrated such that the power feeding roller 68 comes into contact with the secondary transfer outer roller 64. The power feeding roller 68 is configured such that a conductive resin containing a conductive material is coated around a metal roller formed of SUM or SUS. A diameter of the metal roller is around 4 to 15 mm, and a thickness of the conductive resin is 1 to 200 μm. If the diameter of the metal roller is reduced more than that, there is a possibility that the metal roller causes deflection when it is pressurized and becomes unable to apply the voltage uniformly in a longitudinal direction, i.e., in the direction of the axis of rotation, resulting in resistance unevenness on the secondary transfer outer roller 64 and in occurrence of crack or peeling of the conductive resin. If the diameter of the metal roller is increased more than that on the other hand, it may lead to an increase of a material cost and to an increase of size and weight of the power feeding roller 68. Therefore, the diameter of the metal roller is preferable to be set within the abovementioned range.

Examples of the conductive materials contained in the conductive resin include carbon black, carbon fiber and the like. The conductive resin can be prepared as follows. At first, the abovementioned conductive material is dissolved and dispersed within an appropriate organic solvent to obtain a surface layer coating liquid. Next, this surface layer coating liquid is applied to the outer circumference of the metal roller by means of ring coating, dip coating, spray coating or the like and is then dried to remove the organic solvent. It is desirable to execute this drying process under an environment of around 30 to 60° C. so as not to induce a radical reaction. After that, the resin is cured by ultraviolet rays by using an ultraviolet ray irradiator to obtain the abovementioned power feeding roller 68. The conductive resin of 10 μm is coated on the sheet SUS metal roller having a diameter of 8 mm by using the dip coating. The conductive resin used is what perfluoropolyether and zinc antimonateare have been added to acryl resin. A spring pressure of the power feeding roller 68 is set at 500 gf, i.e., about 4.9 N, of total pressure. This arrangement makes it possible to prevent the power feeding roller 68 from deflecting while restraining an increase of costs of parts and an increase of size of the secondary transfer portion 12. It is noted while the case of coating the surface layer of the power feeding roller 68 is described in the present embodiment, the present disclosure is not limited to such case, and the SUM or SUS metal roller may be used as it is or the surface may be plated.

During an image forming operation, the secondary transfer outer roller 64 rotates following a travel of the intermediate transfer belt 56. The power feeding roller 68 also follows the rotation of the secondary transfer outer roller 64. When the sheet S is sent to the secondary transfer portion 12 by the registration roller 66 after undergoing various controls, a secondary transfer voltage having a polarity reverse to that of the charged toner is applied to the power feeding roller 68 to secondarily transfer the toner image formed on the intermediate transfer belt 56 onto the sheet S. Assuming that the toner has a negatively charged polarity, a positive bias is applied as the secondary transfer bias in the present embodiment.

It is noted that an environment detecting sensor 85 configured to detect an environment such as temperature and humidity within the apparatus body and a density detecting sensor 86 are provided within the apparatus body. The density detection sensor 86 is disposed so as to face the surface of the intermediate transfer belt 56 downstream of all of the primary transfer portions 11*a* through 11*d* and upstream of the secondary transfer portion 12 to be able to detect the toner image on the intermediate transfer belt 56.

Controller

Figure 2:
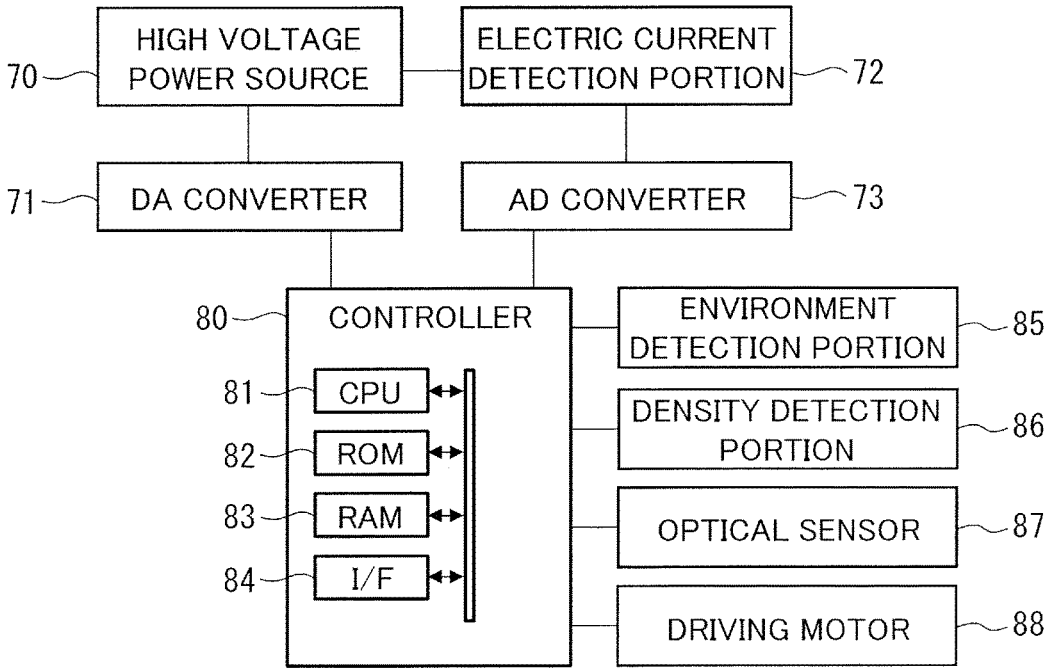
FIG. 2 is a schematic control block diagram of the image forming apparatus of the first embodiment.

As illustrated in FIG. 2, the controller 80 is composed of a computer and includes a CPU 81, a ROM 82 configured to store programs for controlling each part, a RAM configured to temporarily storing data, an input/output circuit (I/F) 84 configured to input/output a signal to/from an external device. The CPU 81 is a microprocessor managing whole controls of the image forming apparatus 1 and is a main body of a system controller. The CPU 81 is connected with each part of the image forming apparatus 1 through the input/output circuit 84, exchanges a signal with each part and controls an operation thereof. The ROM 82 stores an image forming control sequence for forming an image on the sheet S, a high voltage output table indicating a relationship between temperature and humidity and voltage to be applied to the power feeding roller 68, or the like. It is noted that the CPU 81 controls the high voltage power source 70 by making reference to the high voltage output table to apply the secondary transfer bias and a cleaning bias described later to the power feeding roller 68.

Still further, the controller 80 is connected with a DA converter 71, an AD converter 73, an environment detecting sensor 85, a density detecting sensor 86, an optical sensor 87, a driving motor 88, and others. The DA converter 71 is connected with the high voltage power source 70, converts a digital signal command from the controller 80 into an analog signal to cause the high voltage power source 70 to output a high voltage. The high voltage power source 70 is connected with an electric current detection portion 72 which detects an electric current when the high voltage is outputted. The electric current detection portion 72 is connected with the AD converter 73, and a detection result of the electric current detection portion 72 is converted into a digital signal to be inputted to the controller 80.

If the controller 80 determines that the toners stored in the developing units 53*a* through 53*d* have deteriorated due to durability and to fluctuation of environment, the controller 80 executes a control of discharging the toners in the developing units 53*a* through 53*d* onto the intermediate transfer belt 56 and of collecting them by the belt cleaning unit 65. That is, the controller 80 can execute a cleaning mode (referred to also as a 'cleaning control' hereinafter) during when no image is formed. The cleaning mode is a mode of cleaning the power feeding roller 68 by applying a bias from the high voltage power source 70 to the power feeding roller 68 to transfer toner adhering on the power feeding roller 68 to the intermediate transfer belt 56 through the secondary transfer outer roller 64. An outline of the cleaning mode will be described later with reference to FIGS. 4A through 4D. The controller 80 executes the cleaning mode such that a period in which the cleaning mode is executed includes a first application period T1 and a second application period T2 (see FIG. 5A). The first application period T1 is a period during which a reverse polarity bias having a polarity reverse to that of the transfer bias is continuously applied to the power feeding roller 68 while rotating the secondary transfer outer roller 64, the power feeding roller 68 and the intermediate transfer belt 56. The second application period T2 is a period during which a same polarity bias having a same polarity with that of the transfer bias is continuously applied to the power feeding roller 68 while rotating the secondary transfer outer roller 64, the power feeding roller 68 and the intermediate transfer belt 56.

Here, a rotation time during which the secondary transfer outer roller 64 rotates one revolution will be denoted as t1, and a rotation time during which the power feeding roller 68 rotates one revolution as t2. Then, a time during which a point P serving as a region of the secondary transfer outer roller 64 which has been in contact with the power feeding roller 68 arrives at the secondary transfer portion 12 with the rotation of the secondary transfer outer roller 64 will be denoted as t0 (see FIGS. 4A and 4B), and a longer time among t1 and (t2+t0) will be denoted as tL. In this case, according to the present embodiment, the reverse polarity bias is applied continuously to the power feeding roller 68 by tL or more and (10×tL) or less during the first application period T1 in the cleaning mode. Still further, the same polarity bias is applied continuously to the power feeding roller 68 by tL or more and (10×tL) or less during the second application period T2 in the cleaning mode.

Figure 8A:
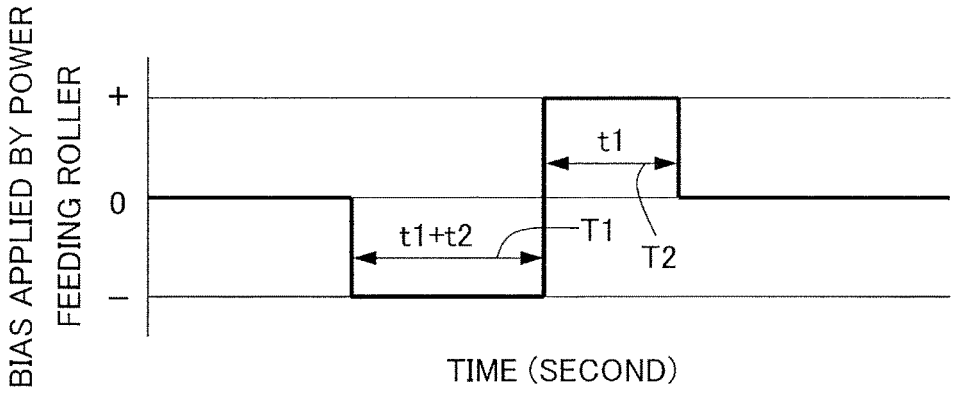
FIG. 8A is a graph indicating a temporal change of a cleaning bias applied to the power feeding roller of the first embodiment in a case where a negative cleaning bias is applied for a total time of a time during which the secondary transfer outer roller rotates one revolution and a time during which the power feeding roller rotates one revolution and a positive cleaning bias is applied for a time during which the secondary transfer outer roller rotates one revolution.

Still further, according to the present embodiment, it is possible to switch and execute first and second cleaning modes as the cleaning mode. The first cleaning mode of the present embodiment is set as follows. That is, when the rotation time during which the secondary transfer outer roller 64 rotates one revolution is denoted as t1, and the rotation time during which the power feeding roller 68 rotates one revolution is denoted as t2, the first application period T1 is set to be (t1+t2) or more and less than 10×(t1+t2) (see FIG. 8A). The controller 80 executes the first cleaning mode after a jam processing when the sheet S is jammed in the present embodiment. Also the controller 80 executes the first cleaning mode after when a predetermined controlling toner image has been formed during an image forming operation. Meanwhile, both the first and second application periods T1 and T2 are set to be less than (t1+t2)

in the second cleaning mode (see FIG. 8A). The controller 80 executes the second cleaning mode in starting or ending the image forming operation.

Still further, the second application period T2 may be set to be shorter than the first application period T1 (see FIG. 8A). In a case where a plurality of first application periods T1 is provided in the cleaning mode of the present embodiment, an initial first application period T1 is set to be longest among the plurality of application periods T1 in the present embodiment (see FIG. 8C). Still further, the reverse polarity bias is applied first among the reverse and same polarity biases in the cleaning mode (see FIG. 8C). The same polarity bias among the reverse and same polarity biases is applied in the end in the cleaning mode (see FIG. 8C).

Figure 6:
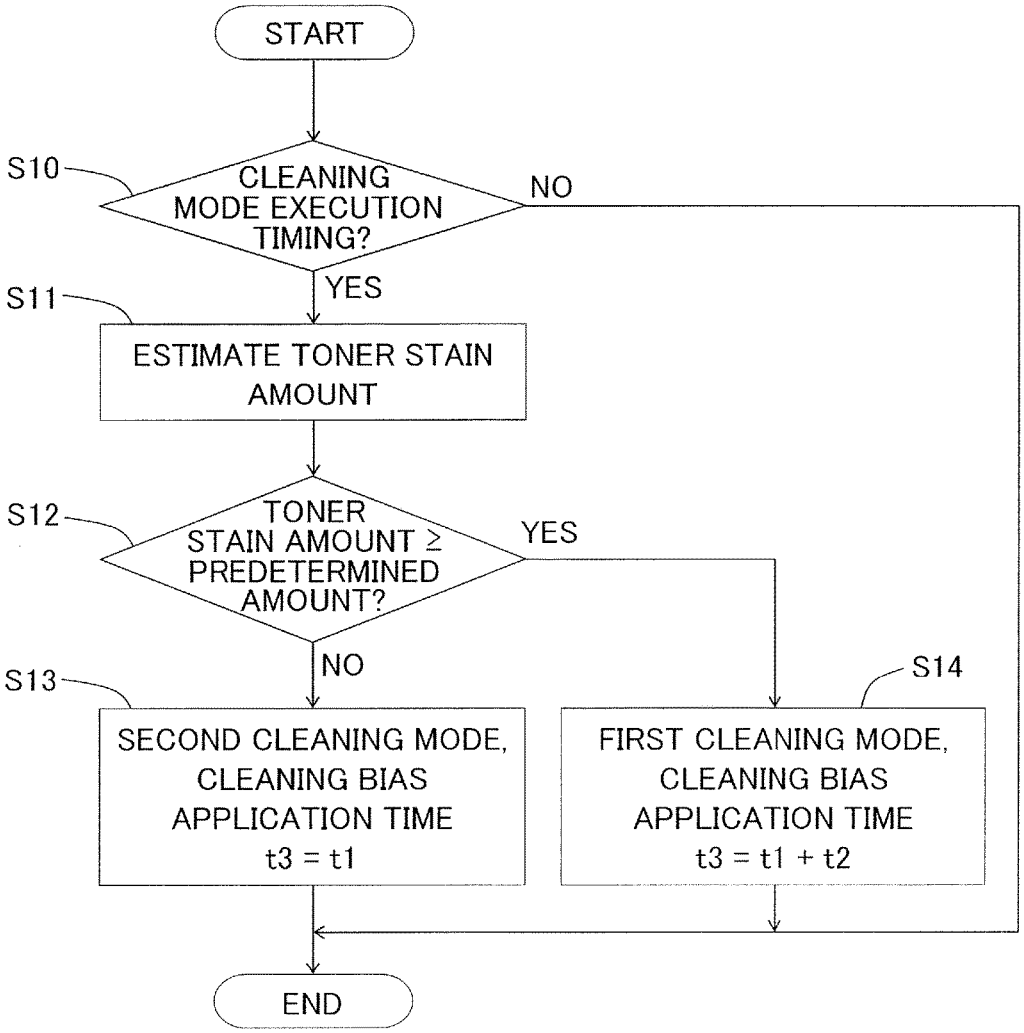
FIG. 6 is a flowchart illustrating a processing procedure of the cleaning mode of the secondary transfer portion in the image forming apparatus of the first embodiment.

In a case where a time during which the controller 80 applies the reverse polarity bias continuously is denoted as t3, the second cleaning mode is a mode in which t3 does not exceed t1+t2 at most and which meets a relationship of t1≤t3<t1+t2 (see Step S13 in FIG. 6). The first cleaning mode is a mode at least having a period meeting a relationship of t3≥t1+t2 (see Step S14 in FIG. 6). A period during which the reverse polarity bias is continuously applied to the power feeding roller 68 is (t1+t2) or more in the first cleaning mode, and a period during which the reverse polarity bias is continuously applied to the power feeding roller 68 is less than (t1+t2) at the longest in the second cleaning mode.

The controller 80 may execute the cleaning mode as follows in executing the cleaning control after when the sheet S is jammed. That is, if an image ratio of an image borne on the intermediate transfer belt 56 at the occurrence of jamming is a predetermined ratio or more, the controller 80 executes the first cleaning mode by setting the first application period T1 as (t1+t2) or more. Meanwhile, if the image ratio of an image borne on the intermediate transfer belt 56 at the occurrence of jamming is less than a predetermined ratio, the controller 80 executes the first cleaning mode or executes the second cleaning mode by setting the first application period T1 as less than (t1+t2) at the longest. The controller 80 also executes the second cleaning mode in executing the cleaning control in starting or ending the image forming operation.

The first cleaning mode may have a period during which the same polarity bias having the same polarity with the transfer bias is applied continuously from the high voltage power source 70 to the power feeding roller 68 for (t1+t2) or more. The second cleaning mode has a period during which the same polarity bias having the same polarity with the transfer bias is applied continuously from the high voltage power source 70 to the power feeding roller 68 for less than (t1+t2) at the longest.

The controller 80 rotates the intermediate transfer belt 56, the secondary transfer outer roller 64 and the power feeding roller 68 while applying the reverse polarity bias from the high voltage power source 70 in the cleaning control. After that, the controller 80 rotates the intermediate transfer belt 56, the secondary transfer outer roller 64 and the power feeding roller 68 while applying the same polarity bias having the same polarity with the transfer bias from the high voltage power source 70 to clean the secondary transfer outer roller 64 and the power feeding roller 68. The controller 80 can also execute the second cleaning mode during a regular operation and can execute the first cleaning mode during a predetermined operation as the cleaning control. Here, the predetermined operation is an operation executed in a case where a toner stain amount is a predetermined amount or more for example, and the regular operation is an operation executed in a case where the toner stain amount is less than a predetermined amount. The controller 80 can also apply the reverse polarity bias so as to meet a relationship of t3=t1+t2 in the first cleaning mode. That is, a period during which the reverse polarity bias is applied continuously to the power feeding roller 68 in the first cleaning mode is t1+t2. The controller 80 can also apply the reverse polarity bias so as to meet a relationship of t3=t1 in the second cleaning mode. That is, a period during which the reverse polarity bias is continuously applied to the power feeding roller 68 in the second cleaning mode is t1.

It is noted that the image forming job is a series of operations as described below carried out based on a print command signal, i.e., an image formation instructing signal. That is, it is a series of operations from a start of a preliminary operation, i.e., a so-called pre-rotation, required in forming an image to a completion of a preliminary operation, i.e., a so-called post-rotation, required in ending the image forming process by going through the image forming steps. Specifically, the image forming job refers to a period from the pre-rotation, i.e., the preliminary operation in forming the image, after receiving the print command signal, i.e., after an input of the image forming job, to the post-rotation, i.e., the operation after forming the image, and includes an image forming period and an inter-sheet period, i.e., a period during which no image is formed. The inter-sheet period is a period corresponding to a space between a toner image formed on one sheet and a toner image formed on a next one sheet in a case where images are formed continuously.

Next, an image forming operation of the image forming apparatus 1 constructed as described above will be described. In response to a start of the image forming operation, the photosensitive drums 50*a* through 50*d* rotate at first such that the surfaces thereof are electrified by the electrifying rollers 51*a* through 51*d*. Then, the exposure units 52*a* through 52*d* emit laser beams to the photosensitive drums 50*a* through 50*d* based on image information to form electrostatic latent images on the surface of the photosensitive drums 50*a* through 50*d*. These electrostatic latent images are visualized as toner images by developing by the developing units 53*a* through 53*d* and are transferred onto the intermediate transfer belt 56.

Meanwhile, in parallel with such toner image forming operation, the sheet S is supplied and is conveyed through a conveyance path to the secondary transfer portion 12 while synchronizing with the toner image on the intermediate transfer belt 56. Then, the toner images are transferred from the intermediate transfer belt 56 onto the sheet S. The sheet S is conveyed to the fixing unit to heat and pressurize the non-fixed toner image to fix onto the surface of the sheet S. The sheet S is then discharged out of the apparatus body.

Figure 3:
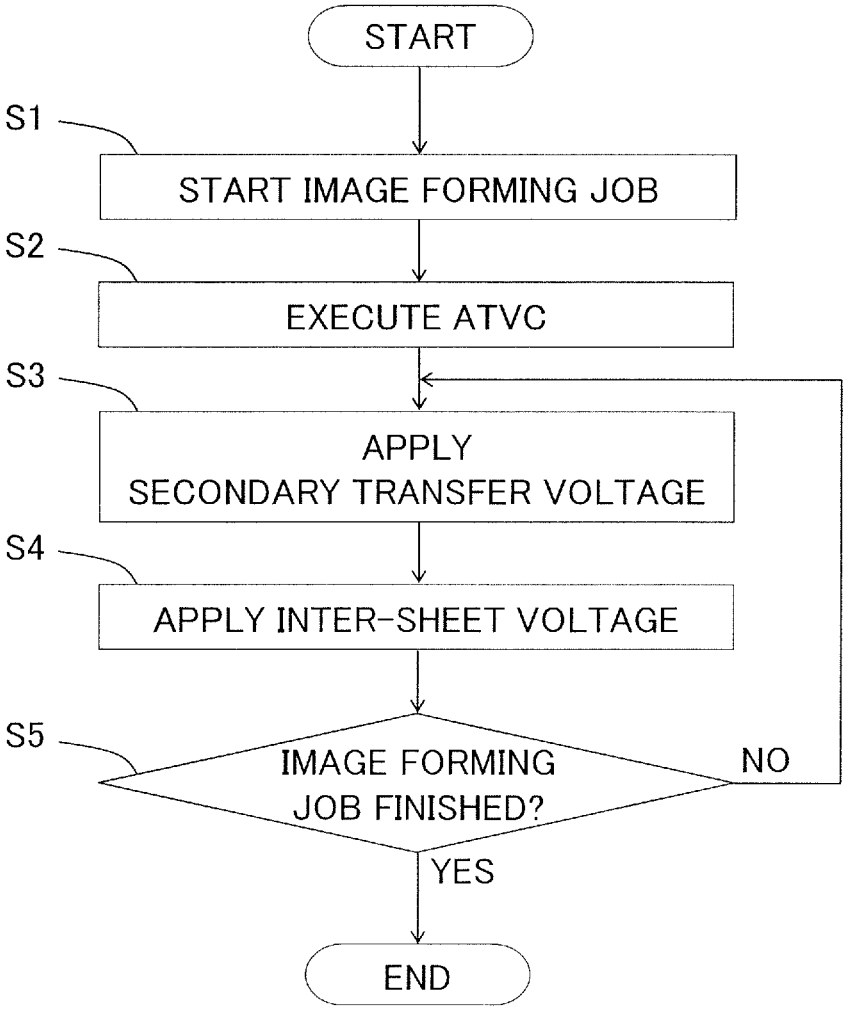
FIG. 3 is a flowchart illustrating a procedure in executing a secondary transfer voltage control in the image forming apparatus of the first embodiment.

Next, the secondary transfer voltage control of the image forming apparatus 1 of the present embodiment will be described along a flowchart illustrated in FIG. 3. In response to a start of an image forming job in Step S1, the controller 80 sets a secondary transfer voltage, i.e., performs an active transfer voltage control (referred to as the 'ATVC' hereinafter) at the pre-rotation such that a desirable secondary transfer electric current value, e.g., −40 μA in the present embodiment, flows in Step S2. Specifically, the controller 80 calculates VI characteristics from electric current values detected respectively when two or more arbitrary voltage values are applied and obtains a voltage value to be applied to obtain a target electric current value. The controller 80 also adds a shared voltage corresponding to a type of the sheet such as a plain sheet and a thick sheet stored in the ROM 82 in advance to the voltage value calculated as described above to set the voltage to be applied to the power feeding roller 68 as a secondary transfer voltage so that the desirable transfer current flows.

The controller 80 carries out the formation of the image by applying the secondary transfer voltage calculated by the ATVC from the power feeding roller 68 to the secondary transfer portion 12 in Step S3. The controller 80 applies an inter-sheet voltage from the power feeding roller 68 to the secondary transfer portion 12 in the inter-sheet period after forming the image in Step S4. The controller 80 also determines whether or not the image forming job has been finished in Step S5. If the controller 80 determines that the image forming job has not been finished, the controller 80 appliesabrital the secondary transfer voltage from the power feeding roller 68 to the secondary transfer portion 12 again to form an image in Step S3. If the controller 80 determines that the image forming job has been finished, the controller 80 finishes the secondary transfer voltage control.

Next, the cleaning control of the secondary transfer portion 12 of the image forming apparatus 1 of the present embodiment will be described. According to the present embodiment, it is possible to execute the cleaning control of applying the cleaning bias to the power feeding roller 68 in a timing of not transferring a toner image onto the sheet S at the secondary transfer portion 12. The timing for executing such cleaning control comes after when a jamming process is executed and when a control mode such as adjustment of toner density and of displacement of a toner image is executed. The jamming process is a process of removing the sheet S which has caused a jam by clogging somewhere on a conveyance path of the image forming apparatus 1 during the image forming operation. In this case, there is a possibility that the jam occurs in a condition in which a toner image is placed on the intermediate transfer belt 56, and a large amount of toner on the intermediate transfer belt 56 may adhere to the secondary transfer outer roller 64 after a jamming process.

Still further, according to the present embodiment, patch images serving as controlling toner images are formed by the respective image forming portions 10*a* through 10*d* in a control mode and are borne on the intermediate transfer belt 56 to be detected by a density detecting sensor 86. Then, based on detection results of the density detecting sensor 86, the controller 80 adjusts the density of the toner images or corrects the displacement of the toner images of the respective image forming portions 10*a* through 10*d*. Because the patch images are not transferred onto the sheet S at the secondary transfer portion 12, the large amount of toner on the intermediate transfer belt 56 may adhere to the secondary transfer outer roller 64 after executing such control mode.

In any case, if a large amount of toner passes through the secondary transfer portion 12 in a state in which there is no sheet S, the large amount of toner may end up adhering to the secondary transfer outer roller 64. Because the toner passes through the secondary transfer portion 12 in the state in which there is no sheet S, the toner is liable to adhere to the secondary transfer outer roller 64. If a next image processing step is executed in the condition in which the toner is adhered to the secondary transfer outer roller 64, there is a possibility of causing back stain by which the toner adheres to a back surface of the sheet S passing through the secondary transfer portion 12. Therefore, in a case where there is a possibility that a large amount of toner adheres to the secondary transfer outer roller 64, the cleaning control of the secondary transfer portion 12 for cleaning the toner adhering the secondary transfer outer roller 64 is executed.

An outline of the cleaning control of the secondary transfer portion 12 will be described with reference to FIGS. 4A through 4D. There are several patterns when the secondary transfer portion 12 causes toner stain t, and a toner stain amount of the secondary transfer portion 12 is different in each case. For instance, the toner stain amount of the secondary transfer portion 12 is less and is such a degree that fogging toner on the intermediate transfer belt 56 after when the sheet S has passed through the secondary transfer portion 12 adheres on the secondary transfer outer roller 64 and the power feeding roller 68 during the post-rotation after a regular image forming process. Accordingly, a bias having a same polarity with the toner, i.e., a reverse polarity bias having a polarity reverse to that of a secondary transfer bias, is applied for the time t1 for one revolution of the secondary transfer outer roller 64 to the power feeding nip portion N between the secondary transfer outer roller 64 and the power feeding roller 68. This arrangement makes it possible to discharge the toner adhering on the secondary transfer outer roller 64 fully to the intermediate transfer belt 56 and to fully clean the secondary transfer outer roller 64.

On the other hand, there is a case where a large amount of toner passes through the secondary transfer portion 12 in a condition in which there is no sheet S right after when the control mode of detecting the patch density on the intermediate transfer belt 56 by the density detecting sensor 86 to correct density is carried out or when sheet jamming has occurred. In this case, there is a possibility that adhesion of the large amount of toner occurs at the secondary transfer portion 12. That is, the toner is liable to adhere on the secondary transfer outer roller 64 because the toner passes through the secondary transfer portion 12 in the condition in which there is no sheet S. The case where the adhesion of the large amount of toner occurs at the secondary transfer portion 12 as described above will be described with reference to FIGS. 4A through 4D.

Figure 4A:
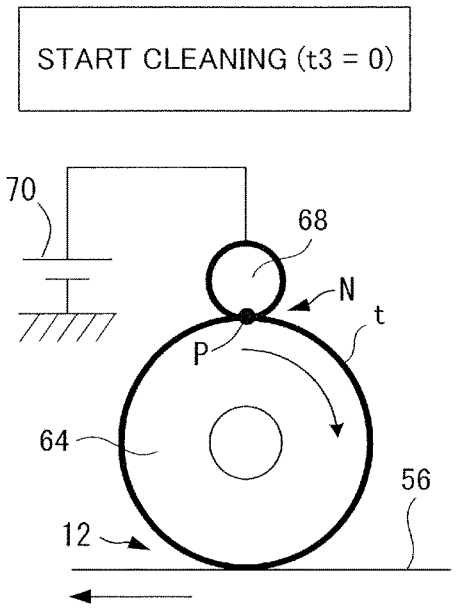
FIG. 4A is a schematic diagram illustrating a procedure in executing a cleaning mode of a secondary transfer portion in a condition in which a secondary transfer outer roller and a power feeding roller are stained by toner in the image forming apparatus of the first embodiment.

As illustrated in FIG. 4A, if the secondary transfer outer roller 64 and the power feeding roller 68 are heavily stained by the toner, the controller 80 applies a bias having the same polarity with the toner, i.e., the reverse polarity bias having a polarity reverse to that of the secondary transfer bias to the power feeding roller 68 as a cleaning bias. When the cleaning of the secondary transfer outer roller 64 is started, the negative charged toner adhering on the secondary transfer outer roller 64 is transferred onto the intermediate transfer belt 56.

Figure 4B:
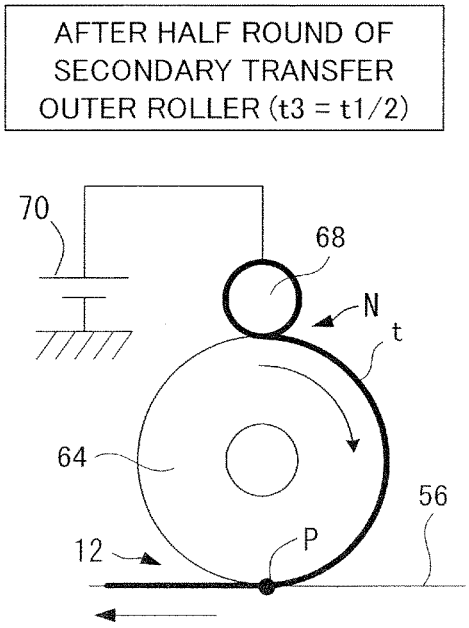
FIG. 4B is a schematic diagram illustrating a procedure in executing the cleaning mode of the secondary transfer portion in a condition in which the secondary transfer outer roller has rotated half in the image forming apparatus of the first embodiment.

Then, as illustrated in FIG. 4B, while the secondary transfer outer roller 64 is put into a condition in which the secondary transfer outer roller 64 has been cleaned by half and the toner stain t is left on a remaining half after when the secondary transfer outer roller 64 rotates half, the toner stain t is still left around the power feeding roller 68. It is because the toner stain t is always left on both the secondary transfer outer roller 64 and the power feeding roller 68 at the power feeding nip portion N between the secondary transfer outer roller 64 and the power feeding roller 68, and the power feeding roller 68 is not cleaned during when the secondary transfer outer roller 64 rotates half. That is, if the large amount of toner exists at the power feeding nip portion N, there is a case where the toner stain t of the power feeding roller 68 is not fully cleaned because the cleaning bias from the power feeding roller 68 becomes insufficient. There is also a possibility that the toner on the secondary transfer outer roller 64 adheres to the power feeding roller 68 by a non-electrostatic adhesion force due to the contact and friction of the secondary transfer outer roller 64 and the power feeding roller 68. Due to that, the cleaning of the power feeding roller 68 is substantially started after when the secondary transfer outer roller 64 rotates half as illustrated in FIG. 4B.

Figure 4C:
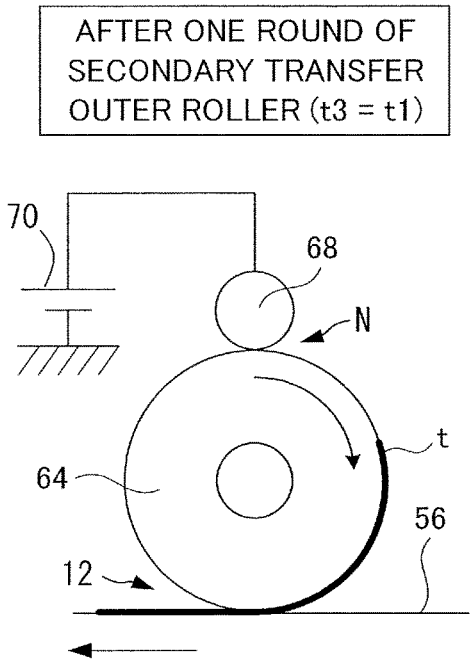
FIG. 4C is a schematic diagram illustrating the procedure in executing the cleaning mode of the secondary transfer portion in a condition in which the secondary transfer outer roller has rotated one revolution in the image forming apparatus of the first embodiment.

After when the secondary transfer outer roller 64 rotates half, the part of the secondary transfer outer roller 64 already cleaned arrives at the power feeding nip portion N. Due to that, the toner stain t remaining on the power feeding roller 68 is transferred onto the secondary transfer outer roller 64, and the power feeding roller 68 is thus cleaned. That is, as illustrated in FIG. 4C, when one revolution of the secondary transfer outer roller 64 has been cleaned, the toner stain t of one revolution of the power feeding roller 68 is left on the secondary transfer outer roller 64.

Figure 4D:
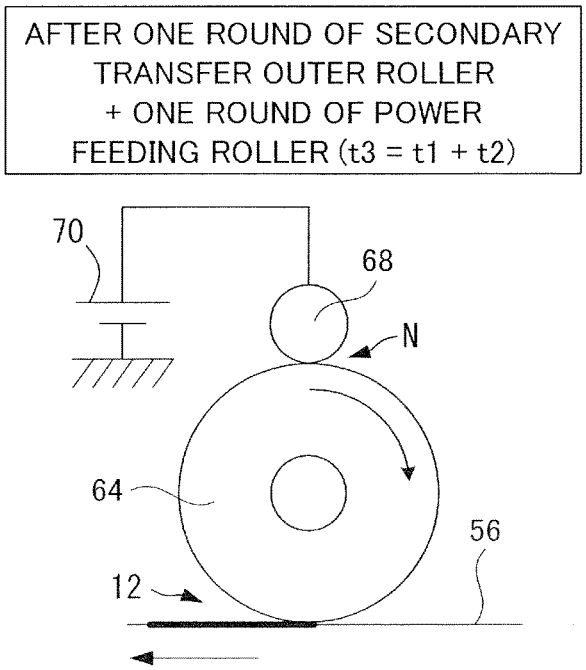
FIG. 4D is a schematic diagram illustrating the procedure in executing the cleaning mode of the secondary transfer portion in a condition in which the power feeding roller has rotated one revolution after when the secondary transfer outer roller had rotated one revolution in the image forming apparatus of the first embodiment.

Then, as illustrated in FIG. 4D, the cleaning of both the secondary transfer outer roller 64 and the power feeding roller 68 can be finished by cleaning for a time t2 for one revolution of the power feeding roller 68 further after cleaning by one revolution of the secondary transfer outer roller 64. Thus, in the case of an external power feeding configuration like the image forming apparatus 1 of the present embodiment, the time t2 for one revolution of the power feeding roller 68 is required in addition to the time t1 for one revolution of the secondary transfer outer roller 64 in order to clean the secondary transfer outer roller 64 and the power feeding roller 68.

Next, the cleaning bias applied to the power feeding roller 68 in the cleaning control of the secondary transfer portion 12 will be described with reference to FIG. 5A. The stain of the secondary transfer outer roller 64 and the power feeding roller 68 can be cleaned by the cleaning bias applied in the cleaning control. While electrically positively charged toner and negatively charged toner are mixed in the toner adhering on the secondary transfer outer roller 64, the toner is drawn back onto the intermediate transfer belt 56 by utilizing this electrical characteristic. The positively charged toner can be cleaned by applying the same polarity bias having the same polarity with the secondary transfer bias in a direction from the power feeding roller 68 to the secondary transfer inner roller 62 as the cleaning bias. The negatively charged toner can be cleaned by applying the reverse polarity bias having a polarity reverse to that of the secondary transfer bias in a direction from the secondary transfer inner roller 62 to the power feeding roller 68.

The biases can be applied in both directions between the power feeding roller 68 and the secondary transfer inner roller 62 while interposing the secondary transfer outer roller 64 by causing the secondary transfer outer roller 64 to electrically float. Therefore, the secondary transfer outer roller 64 and the power feeding roller 68 can be cleaned by one high voltage power source 70.

In the case of cleaning the secondary transfer outer roller 64 and the power feeding roller 68, an application time t3 of a bias voltage is set as follows. In cleaning these rollers, it is preferable to provide the time t2 required for the stain of the power feeding roller 68 arriving at the secondary transfer portion 12 by the rotation of the secondary transfer outer roller 64 after when it has been transferred to the secondary transfer outer roller 64 in addition to the time t1 for one revolution of the secondary transfer outer roller 64. As illustrated in FIG. 5A, in response to the cleaning control, the controller 80 applies a negative reverse polarity bias as the cleaning bias for the time t2 for one revolution of the power feeding roller 68 in addition to the time t1 for one revolution of the secondary transfer outer roller 64, i.e., t3=t1+t2. The time t3 here corresponds to the first application period T1. Thereby, the negatively charged toner adhering on the secondary transfer outer roller 64 and the power feeding roller 68 can be removed. Next, the controller 80 applies a positive same polarity bias as the cleaning bias for the equal time t3=t1+t2. The time t3 here corresponds to the second application period T2. This arrangement makes it possible to remove the positively charged toner adhering on the secondary transfer outer roller 64 and the power feeding roller 68. In the case where the external power feeding configuration is adopted and the positive and negative bias voltages are applied as described above, it is preferable to apply the bias voltage for the time longer than the time t1 for one revolution of the secondary transfer outer roller 64 by the time t2 for one revolution of the power feeding roller 68.

However, if the cleaning bias is applied always for the time t1+t2, there is a possibility that it becomes an excessive cleaning process if the toner stain amount of the secondary transfer outer roller 64 and the power feeding roller 68 is less for example, thus lowering productivity of the image formation. Then, as a countermeasure, the present embodiment makes it possible to clean the power feeding roller 68 and the secondary transfer outer roller 64 favorably while shortening a processing time by switching the processing time in the cleaning control corresponding to a toner adhesion amount of the secondary transfer portion 12 in the externally power feeding configuration.

Here, a processing procedure of the cleaning control of the secondary transfer outer roller 64 and the power feeding roller 68 in the present embodiment will be described along a flowchart illustrated in FIG. 6. When the power source of the image forming apparatus 1 is ON, the controller 80 determines whether it is a time to execute the cleaning control (cleaning mode) in Step S10. Here, the time to execute the cleaning control is a time when the power source of the image forming apparatus 1 is ON, when a user carries out an image forming job, in recovering from a paper jam, when a control for discharging deteriorated toner is carried out, or the like for example. That is, it is a time when the image forming apparatus 1 is started from a state in which its operation is stopped, when a large amount of toner is supplied to the secondary transfer portion in a state in which there is no sheet S, or the like. However, it is a matter of course that the present disclosure is not limited to such cases.

In a case where the controller 80 determines that it is not a time to execute the cleaning control, the controller finishes the process. In a case where the controller 80 determines that it is a time to execute the cleaning control, the controller 80 detects an operation history of the image forming apparatus 1 and estimates a toner stain amount of the secondary transfer outer roller 64 or the power feeding roller 68 in Step S11. At this time, the CPU 81 reads the operation history of the image forming apparatus 1 stored in the ROM 82 or the RAM 83 to estimate the toner stain amount. The operation history is information concerning the toner stain amount of the secondary transfer outer roller 64 or the power feeding roller 68. For instance, the information includes an application time of a cleaning bias in a previous cleaning control, an image ratio and a number of printed sheets in an image forming process after the previous cleaning control, whether or not a sheet is jammed, whether or not toner is discharged, whether or not a patch image has been formed, an image ratio of an image borne on the intermediate transfer belt 56 when a jam occurs, or the like. Due to that, it is possible to suppress an increase of a number of parts because it is not necessary to provide a dedicated member for estimating the toner stain amount.

Here, the toner stain amount of the secondary transfer outer roller 64 or the power feeding roller 68 is assumed to be small at the post-rotation after a regular image forming process for example. However, if the sheet S jams just before the secondary transfer portion 12, a large amount of toner adheres on the secondary transfer outer roller 64 and the power feeding roller 68 because the large amount of toner passes through the secondary transfer portion 12 in the state in which there is no sheet S. Due to that, the toner stain amount of the secondary transfer outer roller 64 or the power feeding roller 68 is assumed to be large. Still further, according to the present embodiment, in a case where the controller 80 determines that the toners stored in the developing units 53*a* through 53*d* have deteriorated due to their durability and to environmental fluctuation, the controller 80 discharges the toners in the developing units 53*a* through 53*d* on to the intermediate transfer belt 56 to collect by the belt cleaning unit 65. A large amount of toner adheres on the secondary transfer outer roller 64 and the power feeding roller 68 also in this case because the large amount of toner passes through the secondary transfer portion 12 in the state in which there is no sheet S. Due to that, the toner stain amount of the secondary transfer outer roller 64 or the power feeding roller 68 is assumed to be large.

The controller 80 determines whether the estimated toner stain amount is a predetermined amount or more in Step S12. If the controller 80 determines that the estimated toner stain amount is not the predetermined amount or more, the controller 80 executes the cleaning control as that of regular operation because the toner stain amount is small. Because the toner stain amount adhering on the secondary transfer outer roller 64 and the power feeding roller 68 is small in this case, the controller 80 executes the second cleaning mode in which the cleaning bias application time t3=t1 in Step S13. That is, in order to clean the negatively charged toner at first, the controller 80 applies the negative reverse polarity bias as the cleaning bias for the time t1 for one revolution of the secondary transfer outer roller 64 as the first application period T1 (see a broken line in FIG. 5B). In succession, in order to clean the positively charged toner, the controller 80 applies the positive same polarity bias as the cleaning bias for the time t1 for one revolution of the secondary transfer outer roller 64 as the second application period T2 (see the broken line in FIG. 5B). Thereby, the toner adhering on the secondary transfer outer roller 64 and the power feeding roller 68 can be discharged onto the intermediate transfer belt 56, and the cleaning control is finished. Thus, it is possible to cut the processing time by setting the time t1 for one revolution of the secondary transfer outer roller 64 each as the application time t3 of the cleaning bias for cleaning the positively and negatively charged toners in the case where the toner stain amount is small.

Meanwhile, in a case where the controller 80 determines that the estimated toner stain amount is the predetermined value or more, the controller 80 executes the cleaning control as a predetermined operation because the toner stain amount is large. Because the toner stain amount adhering on the secondary transfer outer roller 64 and the power feeding roller 68 is large in this case, the controller 80 executes the first cleaning mode in which the cleaning bias application time t3=t1+t2 in Step S14. In this case, it is difficult to discharge the toner from the power feeding roller 68 just by the time t1 for one revolution of the secondary transfer outer roller 64 because much toner exists on the secondary transfer outer roller 64. Therefore, in order to clean the negatively charged toner at first, the controller 80 applies the negative reverse polarity bias as the cleaning bias for the time t1 for one revolution of the secondary transfer outer roller 64 and continuously applies further for the time t2 for one revolution of the power feeding roller 68. That is, the controller 80 applies the reverse polarity bias for a period of at least t1+t2 as the first application period T1. This arrangement makes it possible to clean the toner that has moved from the power feeding roller 68 to the secondary transfer outer roller 64 favorably because the controller 80 applies the reverse polarity bias for the time t3=t1+t2 in total (see a solid line in FIG. 5B).

In succession, in order to clean the positively charged toner, the controller 80 applies the positive same polarity bias as the cleaning bias for the time t1 for one revolution of the secondary transfer outer roller 64 and continuously applies further for the time t2 for one revolution of the power feeding roller 68. That is, the controller 80 applies the same polarity bias at least for the period of t1+t2 as the second application period T2. This arrangement makes it possible to clean the toner that has moved from the power feeding roller 68 to the secondary transfer outer roller 64 favorably because the controller 80 applies the same polarity bias for the time t3=t1+t2 in total (see the solid line in FIG. 5B). Thereby, the toner on the secondary transfer outer roller 64 and the power feeding roller 68 can be discharged onto the intermediate transfer belt 56, and the cleaning control is finished. Thus, in the case where the toner stain amount is large, it is possible to realize the full cleaning of the secondary transfer outer roller 64 and the power feeding roller 68 by setting the cleaning bias application time t3 as t1+t2 respectively for the positively and negatively charged toners.

That is, according to the present embodiment, in a case where the sheet S is jammed, i.e., Yes in Step S10, for example and if an image ratio of an image formed immediately before that is less than a predetermined ratio, i.e., No in Step S12, the controller 80 executes the second cleaning mode in Step S13. Still further, in a case where the sheet S is jammed, i.e., Yes in Step S10, for example and if the image ratio of an image formed immediately before that is a predetermined ratio or more, i.e., Yes in Step S12, the controller 80 executes the first cleaning mode in Step S14. It is noted that while the present embodiment describes the case where the controller 80 executes the cleaning control by switching the first and second cleaning modes corresponding to the image ratio for example when a jam occurs, the present disclosure is not limited to such arrangement. For instance, it is also possible to arrange such that the controller 80 always executes the first cleaning mode regardless of the image ratio when a jam occurs.

As described above, according to the image forming apparatus 1 of the present embodiment, the controller 80 executes the cleaning mode such that the period in which the cleaning mode is executed includes the first application period T1 during which the reverse polarity bias is applied and the second application period T2 during which the same polarity bias is applied. This arrangement makes it possible to electrostatically move both the negatively and positively charged toners respectively to the intermediate transfer belt 56 and to realize effective cleaning by executing the cleaning mode. Thus, this arrangement makes it possible to restrain a defective image otherwise caused by the toner adhering on the power feeding roller 68 in the image forming apparatus 1 including the power feeding roller 68.

Still further, according to the image forming apparatus 1 of the present embodiment, the controller 80 has the first cleaning mode having the period during which the reverse polarity bias is continuously applied to the power feeding roller 68 for (t1+t2) or more as the cleaning control. This arrangement makes it possible to electrostatically move and to clean the toners adhering on the secondary transfer outer roller 64 and the power feeding roller 68 to the intermediate transfer belt 56. Thus, this arrangement makes it possible to restrain the toner from adhering again to the sheet S without providing a different cleaning member to the power feeding roller 68 in the image forming apparatus 1 including the power feeding roller 68.

Still further, according to the image forming apparatus 1 of the present embodiment, the controller 80 can switch and execute the second cleaning mode that meets the relationship of t3=t1 and the first cleaning mode that meets the relationship of t3=t1+t2 as the cleaning control. This arrangement makes it possible to avoid the productivity from dropping without prolonging the cleaning bias application time t3 unnecessarily in the second cleaning mode. This arrangement makes it also possible to favorably clean the secondary transfer outer roller 64 and the power feeding roller 68 adhered with the toners without shortening the cleaning bias application time t3 unnecessarily in the first cleaning mode. Thus, this arrangement makes it possible to avoid the drop of the productivity while favorably keeping the electrostatic cleaning characteristics of the secondary transfer outer roller 64 and the power feeding roller 68 adhered with the toners.

Still further, according to the image forming apparatus 1 of the present embodiment, the controller 80 can rotate the intermediate transfer belt 56, the secondary transfer outer roller 64 and the power feeding roller 68 while applying the reverse polarity bias having a polarity reverse to that of the transfer bias from the high voltage power source 70 in the cleaning control. After that, the controller 80 can clean the secondary transfer outer roller 64 and the power feeding roller 68 by rotating the intermediate transfer belt 56, the secondary transfer outer roller 64 and the power feeding roller 68 while applying the same polarity bias having a same polarity with the transfer bias from the high voltage power source 70. This arrangement makes it possible to clean the negatively charged toner by applying the reverse polarity bias and to clean the positively charged toner by applying the same polarity bias in succession. Thus, this arrangement makes it possible to clean both the negatively and positively charged toners by the series of operations and to realize the effective cleaning.

Still further, according to the image forming apparatus 1 of the present embodiment, in a case where the controller 80 determines that an estimated toner stain amount is less than a predetermined value, the controller 80 executes the second cleaning mode assuming that a regular operation has been carried out. In a case where the controller 80 determines that an estimated toner stain amount is a predetermined value or more, the controller 80 executes the first cleaning mode assuming that a predetermined operation has been carried out. Because the controller 80 switches the cleaning modes thus corresponding to the degree of the toner stain amount, it is possible to avoid the drop of the productivity while favorably keeping the electrostatic cleaning characteristics of the secondary transfer outer roller 64 and the power feeding roller 68 adhered with the toners.

Still further, according to the image forming apparatus 1 of the present embodiment, the controller 80 applies the reverse polarity bias such that the cleaning bias application time t3=t1 in the second cleaning mode. Thus, the controller 80 equalizes the cleaning bias application time t3 with the time t1 for one revolution of the secondary transfer outer roller 64, so that the controller 80 does not prolong the cleaning bias application time t3 unnecessarily while cleaning the whole circumference of the secondary transfer outer roller 64 and can avoid the drop of the productivity. The controller also applies the reverse polarity bias such that the cleaning bias application time t3=t1+t2 in the first cleaning mode. Thus, the controller 80 equalizes the cleaning bias application time t3 with the total time of the time t1 for one revolution of the secondary transfer outer roller 64 and the time t2 for one revolution of the power feeding roller 68. This arrangement makes it possible to favorably clean the secondary transfer outer roller 64 and the power feeding roller 68 adhered with the toners without shortening the cleaning bias application time t3 unnecessarily.

Still further, according to the image forming apparatus 1 of the present embodiment, the controller 80 estimates the toner stain amount based on the operation history of the image forming apparatus 1, so that no dedicated member for estimating the toner stain amount needs to be provided and an increase of a number of parts can be suppressed.

Still further, according to the image forming apparatus 1 of the present embodiment, in the case where the sheet S is jammed, the controller 80 executes the second cleaning mode when the image ratio of an image formed right before the jam is less than a predetermined ratio and executes the first cleaning mode if the image ratio is a predetermined ratio or more. This arrangement makes it possible to avoid the drop of the productivity while keeping the electrostatic cleaning characteristics of the secondary transfer outer roller 64 and the power feeding roller 68 adhered with the toners even if the sheet S is jammed.

It is noted that while the case of applying the reverse polarity bias such that the cleaning bias application time t3=t1 in the second cleaning mode has been described in the image forming apparatus 1 of the first embodiment, the present disclosure is not limited to such case. For instance, the cleaning bias application time t3 may be set so as to meet a relationship of t1≤t3<t1+t2 in the second cleaning mode. This arrangement also makes it possible to avoid the drop of the productivity without prolonging the cleaning bias application time t3 unnecessarily.

Still further, while the case in which the reverse polarity bias is applied such that the cleaning bias application time t3=t1+t2 in the first cleaning mode has been described in the image forming apparatus 1 of the first embodiment, the present disclosure is not limited to such arrangement. For instance, the cleaning bias application time t3 may be set so as to meet a relationship of t3≥t1+t2 in the first cleaning mode. This arrangement also makes it possible to clean the secondary transfer outer roller 64 and the power feeding roller 68 favorably without shortening the cleaning bias application time t3 unnecessarily. It is noted that while the time t3 may be set so as to meet the relationship of t3≥t1+t2 in the first cleaning mode, it is preferable to set the period during which the cleaning bias is applied as (t1+t2)×10≥t3≥t1+t2 in order to avoid the drop of the productivity. It is more preferable to set the period during which the cleaning bias is applied as (t1+t2)×5≥t3≥t1+t2. This arrangement makes it possible to avoid the drop of the productivity while keeping the electrostatic characteristic for cleaning the secondary transfer outer roller 64 and the power feeding roller 68.

Still further, while the case in which the same polarity bias is applied for the time t3=t1+t2 which is equal with the application time of the reverse polarity bias after applying the reverse polarity bias has been described in the image forming apparatus 1 of the present embodiment, the present disclosure is not limited to such arrangement. The application time of the same polarity bias may be different from the application time of the reverse polarity bias. For instance, in a case where an application time of the reverse polarity bias is set to be t1, an application time of the same polarity bias may be set as t1+t2. Or, as illustrated in FIG. 8A for example, in a case where an application time of the reverse polarity bias is set as t1+t2 as the first application period T1 in the first cleaning mode, an application time of the same polarity bias may be set as t1 as the second application period T2. It is because the toner adhering on the secondary transfer outer roller 64 and the power feeding roller 68 is considered to be mostly the negatively charged toner, so most of the toner can be cleaned by the application of the reverse polarity bias of the first time. Therefore, as illustrated in FIG. 8A, a time during which the same polarity bias is applied may be arranged to be a time during which the secondary transfer outer roller 64 rotates at least one revolution. In other words, in a case where a maximum time during which the same polarity bias is continuously applied in the first cleaning mode is denoted as t4, it may be arranged so as to meet a relationship of t1≤t4<t1+t2.

Figure 8B:
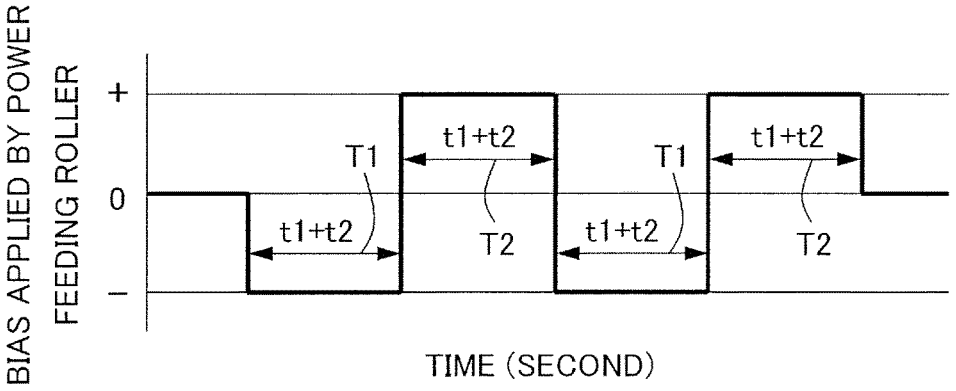
FIG. 8B is a graph indicating a temporal change of a cleaning bias applied to the power feeding roller of the first embodiment in a case where negative and positive cleaning biases are applied alternately by two time each for each total time of a time during which the secondary transfer outer roller rotates one revolution and a time during which the power feeding roller rotates one revolution.
Figure 8C:
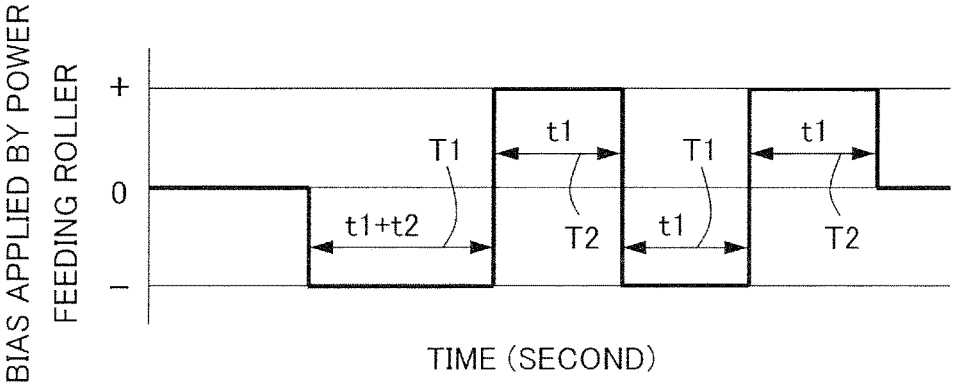
FIG. 8C is a graph indicating a temporal change of a cleaning bias applied to the power feeding roller of the first embodiment in a case where a negative cleaning bias is applied for a total time of a time during which the secondary transfer outer roller rotates one revolution and a time during which the power feeding roller rotates one revolution and a positive cleaning bias, a negative cleaning bias, and a position cleaning bias are applied in order for a time during which the secondary transfer outer roller rotates one revolution.

Still further, the arrangement in which the reverse polarity bias and the same polarity bias are applied sequentially by one time each has been described in the respective cleaning modes in the image forming apparatus 1 of the first embodiment, an arrangement may be made such that the reverse polarity bias and the same polarity bias are sequentially applied further after applying the reverse polarity bias and the same polarity bias sequentially as illustrated in FIG. 8B. In this case, an application time of the reverse polarity bias is set to be t1+t2 as a first-time first application period T1, and an application time of the same polarity bias is set to be t1+t2 as a first-time second application period T2. Then, an application time of the reverse polarity bias may be set to be t1 as a second-time first application period T1, and an application time of the same polarity bias may be set to be t1 as a second-time second application period T2. Or, as illustrated in FIG. 8C, an application time of the reverse polarity bias is set to be t1+t2 as a first-time first application period T1 for example in the first cleaning mode. After that, an application time of the same polarity bias is set to be t1 as a first-time second application period T2, an application time of the reverse polarity bias is set to be t1 as a second-time first application period T1, and an application time of the same polarity bias may be set to be t1 as a second-time second application period T2. That is, the bias applied continuously after the application of the first-time reverse polarity bias may be that of a time during which the secondary transfer outer roller rotates at least one revolution. The application time of the same polarity bias can be shortened as illustrated in FIGS. 8B and 8C because most of the toner adhering on the secondary transfer outer roller 64 and the power feeding roller 68 can be cleaned by the application of the reverse polarity bias of the first time.

Still further, while the cleaning control has been configured to apply both the reverse polarity bias and same polarity bias in the image forming apparatus 1 of the first embodiment, the present disclosure is not limited to such configuration. For instance, it may be configured such that only the reverse polarity bias is applied and no same polarity bias is applied. It is because a content of the positively charged toner is small within the developer as compared to the negatively charged toner. However, it is preferable to apply both the reverse polarity bias and same polarity bias in order to realize a favorable cleaning performance.

Still further, while the case where a rotation time during which the secondary transfer outer roller 64 rotates one revolution is denoted as t1, a rotation time during which the power feeding roller 68 rotates one revolution is denoted as t2, and t1>t2 in the image forming apparatus 1 of the first embodiment, an arrangement may be made such that t1<t2. In this case, a time during which the bias of each polarity is applied (see Step S13) may be not t1 but be t2 in the second cleaning mode. That is, in the case of t1<t2, it is possible to arrange such that the secondary transfer outer roller 64 and the power feeding roller 68 rotate one revolution each during when the biases of the respective polarities are continuously applied by setting the time during which the biases of the respective polarities are applied as t2 in the second cleaning mode.

Still further, while the case where the application time of the reverse polarity bias and the same polarity bias is set to be t1+t2 each in the first cleaning mode has been described in the image forming apparatus 1 of the first embodiment, the present disclosure is not limited to such case. For instance, an application time may be shorter than t1+t2 in a case where the toner adhering on the power feeding roller can be immediately discharged to the secondary transfer outer roller 64 along with the application of the reverse polarity bias even in the first cleaning mode. In this case, a position of a cross point of a line, connecting centers of the secondary transfer outer roller 64 and the power feeding roller 68 at the time of start of the application of the cleaning bias, with the secondary transfer outer roller 64 is denoted as a point P (see FIG. 4A). That is, the point P is a point where the secondary transfer outer roller 64 is in contact with the power feeding roller 68 at the time of start of the cleaning. If the secondary transfer outer roller 64 rotates half, the point P arrives at the intermediate transfer belt 56, i.e., at the secondary transfer portion 12 (see FIG. 4B). If a time during which the secondary transfer outer roller 64 rotates half is denoted as t0 (=t½), a time required for conveying the toner of one revolution adhering on the power feeding roller 68 to the intermediate transfer belt 56 through the intermediary of the secondary transfer outer roller 64 is (t2+t0). Meanwhile, a time required for conveying the toner of one revolution adhering on the secondary transfer outer roller 64 to the intermediate transfer belt 56 is t1. It is noted that because the power feeding nip portion N and the secondary transfer portion 12 are disposed at positions deviated approximately by 180° in the rotation direction of the secondary transfer outer roller 64 in the present embodiment, t0=t½. However, the positions of the power feeding nip portion N and the secondary transfer portion 12 are not always deviated by 180°. In a case when they are deviated by an angle other than 180°, the time t0 during which the secondary transfer outer roller 64 rotates half is not equal to t½.

Then, in order to convey the toners adhering on both the power feeding roller 68 and the secondary transfer outer roller 64 to the intermediate transfer belt 56, the continuous application time of the reverse polarity bias and the same polarity bias may be a longer time or more among t1 and (t2+t0). That is, if t1≥(t2+t0), it is preferable to have a period during which the reverse polarity bias and the same polarity bias are respectively applied continuously at least for t1 or more in the cleaning control. Still further, if t1<(t2+t0), it is preferable to have a period during which the reverse polarity bias and the same polarity bias are respectively applied continuously at least for (t2+t0) or more in the cleaning control. This arrangement makes it possible to avoid the drop of the productivity while favorably keeping the electrostatic cleaning characteristics of the secondary transfer outer roller 64 and the power feeding roller 68. Still further, the continuous application time of the reverse polarity bias and the same polarity bias may be a longer time or more among t1 and (t2+t0) also in the second cleaning mode.

Still further, in the case where the continuous application time of the cleaning bias is set to be the longer time or more among t1 and (t2+t0), it is preferable to set an upper limit value to the continuous application time by taking the productivity into account. For instance, if the longer time among t1 and (t2+t0) is denoted as tL, the continuous application time of the cleaning bias is preferable to be tL×10 or less at the longest and is more preferable to be tL×5 or less. This arrangement makes it possible to avoid the drop of the productivity while favorably keeping the electrostatic cleaning characteristics of the secondary transfer outer roller 64 and the power feeding roller 68.

Second Embodiment

Next, a second embodiment of the present disclosure will be described in detail with reference to FIG. 7. The present embodiment is different from the configuration of the first embodiment in that a toner stain amount of the power feeding roller 68 is detected by an optical sensor 87 (see FIG. 1). A configuration of the present embodiment other than that is same with the configuration of the first embodiment, so that a detailed description of the other configuration will be omitted here while denoting with the same reference numerals.

According to the present embodiment, the optical sensor 87 serving as a detection portion is provided so as to face the surface of the power feeding roller 68 as illustrated in FIG. 1. The optical sensor 87 is connected with the controller 80 (see FIG. 2) and can detect reflectivity of the surface of the power feeding roller 68 as a value related with the toner stain of the power feeding roller 68. The optical sensor 87 detects a regular reflection component of a reflection light of a light irradiated from a light-emitting portion to the surface of the power feeding roller 68. The optical sensor 87 determines a toner adhesion amount by utilizing a phenomenon that the more the tonner adhesion amount of the power feeding roller 68, the less the regular reflection component is, and the less the toner adhesion amount, the more the regular reflection component is. In a case where the reflectivity detected by the optical sensor 87 is less than a predetermined value, the controller 80 executes the second cleaning mode by assuming that the first application period T1 is less than (t1+t2). The controller 80 also executes the first cleaning mode by assuming that the first application period T1 is (t1+t2) or more in a case where the reflectivity is a predetermined value or more.

Figure 7:
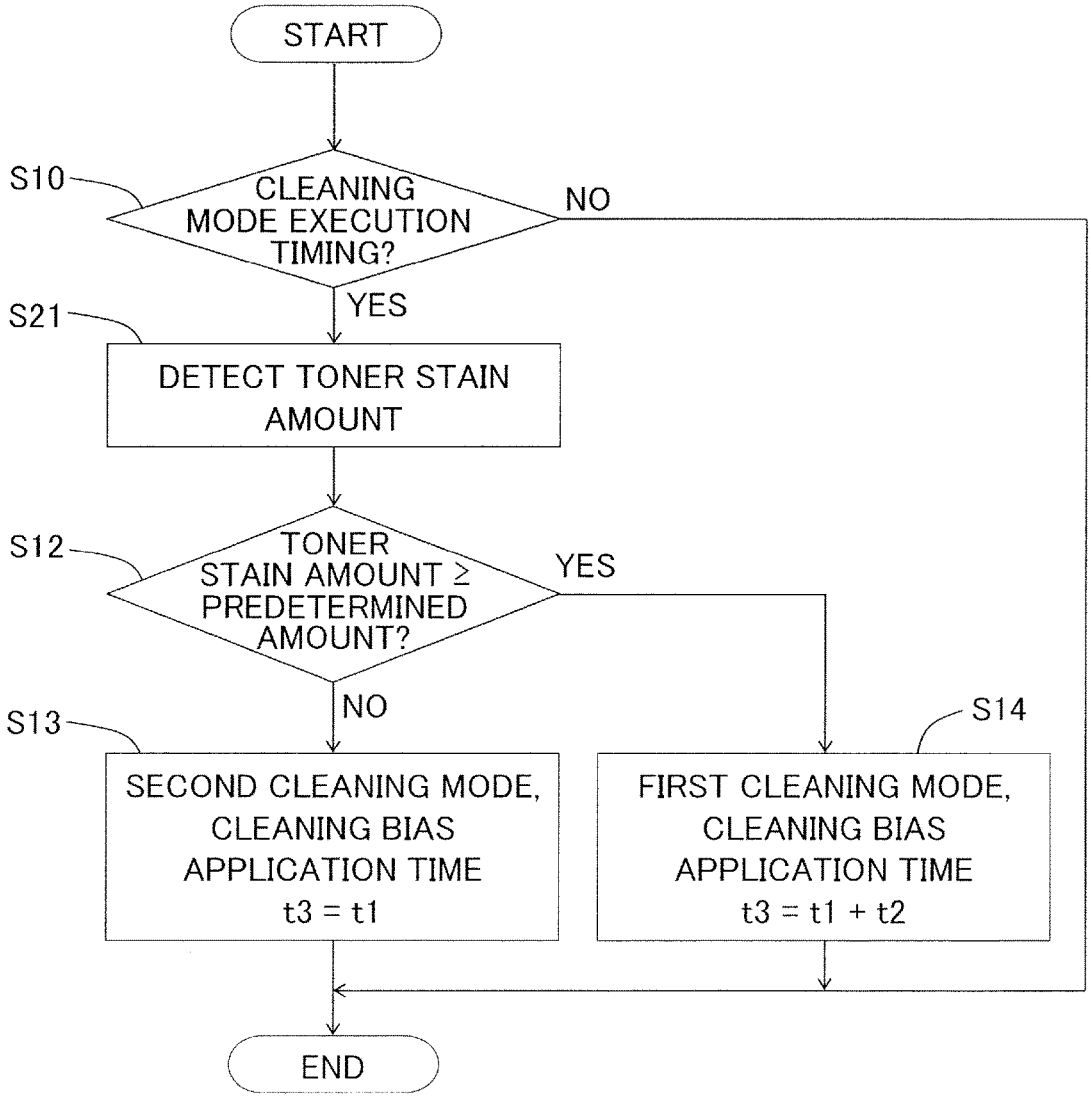
FIG. 7 is a flowchart illustrating a processing procedure of the cleaning mode of the secondary transfer portion in the image forming apparatus of a second embodiment.

While a processing procedure of the cleaning control of the secondary transfer outer roller 64 and the power feeding roller 68 of the present embodiment is different from that of the first embodiment in that Step S21 is provided as illustrated in FIG. 7 instead of Step S11 in the flowchart illustrated in FIG. 6, the other processing steps are the same. As illustrated in FIG. 7, when the power source of the image forming apparatus 1 is ON, the controller 80 determines whether it is a time to execute the cleaning control in Step S10.

In a case when the controller 80 determines that it is a time to execute the cleaning control, the controller 80 detects reflectivity of the power feeding roller 68 from the optical sensor 87 and based on that, detects a toner stain amount of the power feeding roller 68 in Step S21. The controller 80 determines the toner stain amount by setting a reflection light quantity of the power feeding roller 68 in a state in which the power feeding roller 68 is new as stored in the ROM 82 in advance as a reflection light quantity in a case where there is no toner adhesion. Then, if the controller 80 detects that the reflection light quantity is half or less from the new state for example, the controller 80 determined that the toner adhesion amount is large. Next, the controller 80 determines whether the toner stain amount is a predetermined value or more in the same manner with the first embodiment in Step S12. If the toner stain amount is not the predetermined value or more, the controller 80 executes the second cleaning mode in Step S13 and executes the first cleaning mode in Step S14 if the toner stain amount is the predetermined value or more.

The cleaning control executed in cleaning the secondary transfer outer roller 64 and the power feeding roller includes the first application period during which the reverse polarity bias is applied and the second application period during which the same polarity bias is applied also in the image forming apparatus 1 of the present embodiment. Therefore, both the negatively and positively charged toners can be electrostatically transferred respectively to the intermediate transfer belt 56 by executing the cleaning control and thus the effective cleaning can be realized. This arrangement makes it possible to restrain the defective image otherwise caused by the toner adhering on the power feeding roller 68 in the image forming apparatus 1 including the power feeding roller 68.

Still further, according to the image forming apparatus 1 of the present embodiment, the controller 80 has the first cleaning mode having a period during which the reverse polarity bias is applied continuously to the power feeding roller 68 for (t1+t2) or more as the cleaning control. Therefore, it is possible to clean the secondary transfer outer roller 64 and the power feeding roller 68 by electrostatically transferring the toner adhering on the secondary transfer outer roller 64 and the power feeding roller 68 to the intermediate transfer belt 56. Thus, this arrangement makes it possible to restrain the toner from adhering again onto the sheet S without separately providing a cleaning member for the power feeding roller 68 in the image forming apparatus 1 including the power feeding roller 68.

Still further, according to the image forming apparatus 1 of the present embodiment, it is possible to avoid the drop of the productivity without prolonging the cleaning bias application time t3 unnecessarily in the second cleaning mode. Still further, it is possible to clean the secondary transfer outer roller 64 and the power feeding roller 68 adhered with the toner without shortening the cleaning bias application time t3 unnecessarily in the first cleaning mode. This arrangement also makes it possible to avoid the drop of the productivity while favorably keeping the electrostatic cleaning characteristics of the secondary transfer outer roller and the power feeding roller 68 adhered with the toner. Still further, according to the image forming apparatus 1 of the present embodiment, the optical sensor 87 is applied as the detection portion configured to detect the value related to the toner stain of the power feeding roller 68, it is possible to directly detect the toner stain amount and to execute switching of the cleaning modes at high precision.

It is noted that while the case where the optical sensor 87 can detect the reflectivity of the surface of the power feeding roller 68 has been described in the image forming apparatus 1 of the second embodiment described above, the present disclosure is not limited to such case and the optical sensor 87 may be arranged so as to be able to detect reflectivity of the surface of the secondary transfer outer roller 64 for example. That is, the optical sensor 87 may be configured to be able to detect the reflectivity of at least one of the secondary transfer outer roller 64 and the power feeding roller 68. In either case, it is possible to directly detect the toner stain amount and switching of the cleaning modes can be executed at high precision.

Still further, while the case where the optical sensor 87 is applied as the detection portion detecting the value related to the toner stain of at least one of the secondary transfer outer roller 64 and the power feeding roller 68 has been described in the image forming apparatus 1 of the second embodiment, the present disclosure is not limited to such case. For instance, the detection portion may be an electric current detection portion configured to detect a transfer current of the secondary transfer portion 12. In this case, the controller 80 can detect the toner stain amount of the secondary transfer outer roller 64 by adopting, as a detection value, a value concerning a relationship between an electric current detected by the current detection portion when a test bias is applied to the power feeding roller 68 in forming no image and the applied test bias. Thus, the controller 80 makes it possible to suppress a number of parts from increasing because no dedicated member for detecting the toner stain amount is necessary.

Still further, according to the image forming apparatus 1 of the second embodiment described above, the detection portion may be a current detection portion configured to detect an electric current flowing when a driving motor 88 of the secondary transfer inner roller 62 is driven. In this case, the controller 80 can detect the toner stain amount of the secondary transfer inner roller 62 by setting the current flowing in driving the driving motor 88 and detected by the current detection portion as a detection value. Here, if the toner stain of the secondary transfer outer roller 64 accumulates, rotational resistance of the secondary transfer outer roller 64 at the power feeding nip portion N increases. Due to that, a driving torque of the intermediate transfer belt increases and the current flowing in driving the driving motor 88 fluctuates. Then, the controller 80 detects the driving torque of the intermediate transfer belt 56 based on the current in driving the driving motor 88 of the secondary transfer inner roller 62 and determines that the toner stain amount is large if the driving torque is large. Thus, the controller 80 makes it possible to suppress the increase of the number of parts also in this case because no dedicated member for detecting the toner stain amount is necessary.

EXAMPLES

The toner stain of the power feeding roller 68 was investigated by using the image forming apparatus 1 of the first embodiment by setting a processing speed at 300 mm/sec. of peripheral speed under a temperature and humidity environment of 30° and 80% RH. In operation, no sheet S was used, a full gradation solid image and a halftone image were formed by black toner, the secondary transfer portion 12 was intentionally stained by the toner by passing the images through the secondary transfer portion 12, and then effects of the cleaning control carried out thereafter were verified. The verification of the effects of the cleaning control was conducted by verifying adhesion of the toner on a back surface after feeding a sheet S to the image forming apparatus 1 after executing the cleaning control. The black image and the halftone image were formed without passing the sheet S by stopping the power source of the apparatus body during a period from when an image has been formed and the sheet S passes through the secondary transfer portion 12, and after that, the power source of the apparatus body was turn ON. This arrangement makes it possible to send the toner to the secondary transfer portion 12 without passing the sheet S through the secondary transfer portion 12.

First Example

Figure 5A:
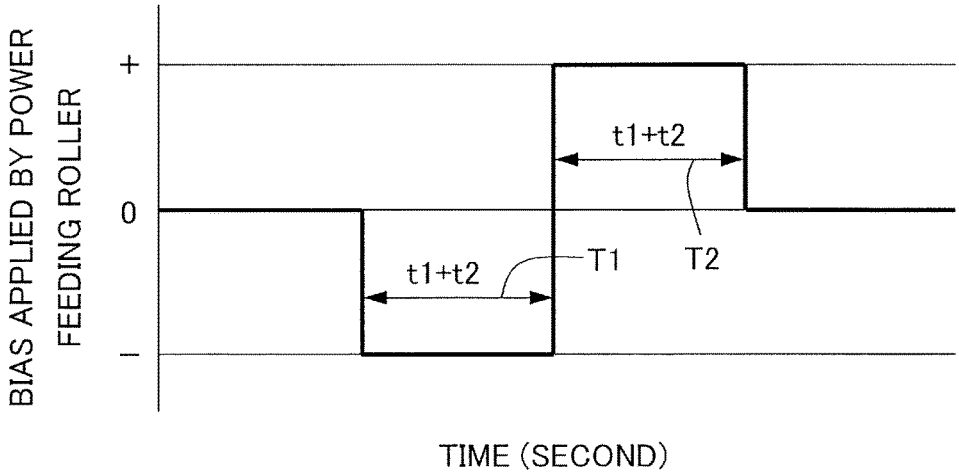
FIG. 5A is a graph indicating a temporal change of a cleaning bias applied to the power feeding roller of the first embodiment in a case where negative and positive cleaning biases are applied by one time each for a total time of a time during which the secondary transfer outer roller rotates one revolution and a time during which the power feeding roller rotates one revolution.

As illustrated in FIG. 5A, while setting the same polarity bias to be 1 kV and the reverse polarity bias to be −1 kV, the respective biases were applied for a total time t1+t2, where t1 is a rotation time during which the secondary transfer outer roller 64 rotates one revolution and t2 is a rotation time during which the power feeding roller 68 rotates one revolution without using the sheet. As a result, it was confirmed that no black toner adheres on the back surface of the sheet S fed after the cleaning control.

Second Example 5000 sheets of A4 size sheet (manufactured by Canon Inc., GF-0081k, basis weight: 81.4 g/m$^2$) were continuously fed. Here, as indicated by the broken line in FIG. 5B, the respective biases were applied for the rotation time t1 during which the secondary transfer outer roller 64 rotates one revolution while setting the same polarity bias to be 1 kV and the reverse polarity bias to be −1 kV. As a result, it was confirmed that no black toner adheres on the back surface of the sheet S fed after the cleaning control.

First Comparative Example

Figure 5B:
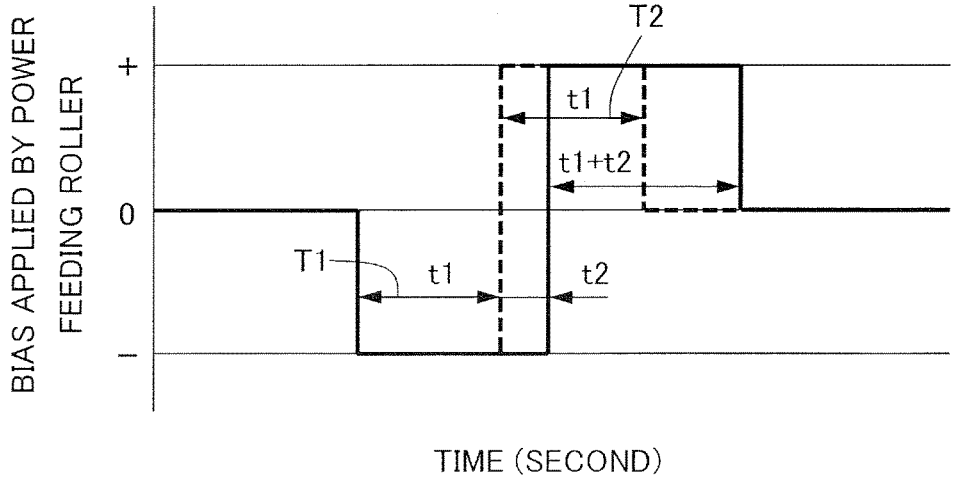
FIG. 5B is a graph indicating a temporal change of a cleaning bias applied to the power feeding roller of the first embodiment in a case where negative and positive cleaning biases are applied one time each for each time during which the secondary transfer outer roller rotates one revolution.

As indicated by the broken line in FIG. 5B, while setting the same polarity bias to be 1 kV and the reverse polarity bias to be −1 kV, the respective biases were applied for the rotation time t1 during which the secondary transfer outer roller 64 rotates one revolution without using a sheet. As a result, it was confirmed that the black toner adheres on a back surface of a sheet S fed after the cleaning control.

Accordingly, it was confirmed that it is possible to avoid the drop of the productivity while favorably keeping the electrostatic cleaning characteristics of the secondary transfer outer roller 64 and the power feeding roller 68 adhered with the toner by using the image forming apparatus 1 of the present embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-168561, filed Aug. 30, 2016, and No. 2017-123737, filed Jun. 23, 2017, which are hereby incorporated by reference wherein in their entirety.

What is claimed is:

1. An image forming apparatus, comprising:

an image bearing member configured to bear a toner image;

a transfer roller comprising a conductive shaft portion and an outer circumferential portion containing a conducting agent and being formed around the shaft portion, the transfer roller forming a transfer portion where the transfer roller is in contact with an outer surface of the image bearing member to transfer the toner image borne on the image bearing member onto a recording medium;

a power feeding rotary member configured to rotate while in contact with the transfer roller to supply electric current to the transfer roller to transfer the toner image at the transfer portion;

a power source configured to apply a transfer bias to the power feeding rotary member; and a controller configured to execute a cleaning mode of cleaning the power feeding rotary member by applying a bias from the power source to the power feeding rotary member to transfer toner adhering on the power feeding rotary member to the image bearing member through the transfer roller in a state that the transfer roller, the power feeding rotary member and the image bearing member are rotating while the transfer roller is in contact with the power feeding rotary member and the transfer roller is in contact with the image bearing member without forming an image, wherein the controller is configured to execute the cleaning mode such that a period in which the cleaning mode is executed includes a first application period during which a reverse polarity bias having a polarity reverse to that of the transfer bias is continuously applied to the power feeding rotary member, and a second application period during which a same polarity bias having a same polarity as that of the transfer bias is continuously applied to the power feeding rotary member.

2. The image forming apparatus according to claim 1, wherein the duration of the first application period is tL or more and (10×tL) or less, and the duration of the second application period is tL or more and (10×tL) or less, where t1 is a rotation time during which the transfer roller rotates one revolution, t2 is a rotation time during which the power feeding rotary member rotates one revolution, t0 is a time during which a region of the transfer roller in contact with the power feeding rotary member arrives at the transfer portion with rotation of the transfer roller, and tL is the longer of t1 and (t2+t0).

3. The image forming apparatus according to claim 1, wherein the duration of the first application period is (t1+t2) or more, where t1 is a rotation time during which the transfer roller rotates one revolution and t2 is a rotation time during which the power feeding rotary member rotates one revolution in the cleaning mode.

4. The image forming apparatus according to claim 3, wherein the controller is configured to execute the cleaning mode after a jam processing in a case where the recording medium is jammed.

5. The image forming apparatus according to claim 3, wherein the controller is configured to execute the cleaning mode after forming a predetermined controlling toner image during an image forming operation.

6. The image forming apparatus according to claim 1, wherein the duration of each of the first and second application periods is both (t1+t2) or more and less than 10×(t1+t2) in a case where the controller executes the cleaning mode based on an occurrence of jamming of the recording medium, where t1 is a rotation time during which the transfer roller rotates one revolution and t2 is a rotation time during which the power feeding rotary member rotates one revolution.

7. The image forming apparatus according to claim 6, wherein the duration of each of the first and second application periods is both less than (t1+t2) in a case where the controller executes the cleaning mode in starting or ending an image forming operation.

8. The image forming apparatus according to claim 1, wherein the duration of the second application period is shorter than that of the first application period.

9. The image forming apparatus according to claim 1, wherein in a case where a plurality of first application periods is provided in the cleaning mode, the duration of the initial one of the first application periods is the longest.

10. The image forming apparatus according to claim 1, wherein among the reverse polarity bias and the same polarity bias in the cleaning mode, the reverse polarity bias is applied first.

11. The image forming apparatus according to claim 1, wherein among the reverse polarity bias and the same polarity bias in the cleaning mode, the same polarity bias is applied last.

12. The image forming apparatus according to claim 1, further comprising a detection portion configured to detect a value related to toner stain of at least one of the transfer roller and the power feeding rotary member, wherein the controller is configured to set the duration of the first application period to be (t1+t2) or more in a case where a detection value of the detection portion is a predetermined value or more and to set the duration of the first application period to be less than (t1+t2) in a case where the detection value is less than the predetermined value, where t1 is a rotation time during which the transfer roller rotates one revolution and t2 is a rotation time during which the power feeding rotary member rotates one revolution.

13. The image forming apparatus according to claim 12, wherein the detection portion is an optical sensor configured to detect reflectivity of a surface of the power feeding rotary member, and wherein the detection value is the reflectivity of the surface.

14. The image forming apparatus according to claim 12, wherein the detection portion is an electric current detection portion configured to detect a transfer current of the transfer portion, and wherein the detection value is a value relating to a relationship between (i) an electric current detected by the electric current detection portion when a test bias is applied to the power feeding rotary member without forming an image and (ii) the applied test bias.

15. The image forming apparatus according to claim 12, further comprising a driving portion configured to rotate the image bearing member, wherein the detection portion is an electric current detection portion configured to detect an electric current flowing in driving the driving portion, and wherein the detection value is the electric current detected by the electric current detection portion in driving the driving portion.

16. The image forming apparatus according to claim 1, wherein in a case where the controller executes the cleaning mode after an occurrence of jamming of the recording medium, the controller is configured to set the duration of the first application period to be (t1+t2) or more if an image ratio of an image borne on the image bearing member is a predetermined ratio or more in a case where the jam occurs and to set the duration of the first application period to be less than (t1+t2) if the image ratio is less than the predetermined ratio in a case where the jam occurs, where t1 is a rotation time during which the transfer roller rotates one revolution and t2 is a rotation time during which the power feeding rotary member rotates one revolution.

17. An image forming apparatus, comprising:

an image bearing member configured to bear a toner image;

a transfer roller comprising a conductive shaft portion and an elastic layer formed around the conductive shaft portion, the transfer roller forming a transfer portion where the transfer roller is in contact with an outer surface of the image bearing member to transfer the toner image borne on the image bearing member onto a recording medium;

a power feeding roller configured to rotate while in contact with the transfer roller to supply electric current to the transfer roller to transfer the toner image at the transfer portion;

a power source configured to apply a transfer bias to the power feeding roller; and a controller configured to execute a cleaning mode of cleaning the power feeding roller by applying a bias from the power source to the power feeding roller to transfer toner adhering on the power feeding roller to the image bearing member through the transfer roller in a period during which no image is formed, wherein the controller is configured to execute the cleaning mode such that a period in which the cleaning mode is executed includes a first period during which a first bias having a polarity reverse to that of the transfer bias is applied to the power feeding roller, and a second period during which a second bias having a same polarity as that of the transfer bias is applied to the power feeding roller.

18. The image forming apparatus according to claim 17, wherein the duration of the first period is tL or more and (5×tL) or less, and the duration of the second period is tL or more and (5×tL) or less, where t1 is a rotation time during which the transfer roller rotates one revolution, t2 is a rotation time during which the power feeding roller rotates one revolution, t0 is a time during which a region of the transfer roller in contact with the power feeding roller arrives at the transfer portion with rotation of the transfer roller, and tL is the longer of t1 and (t2+t0).

19. The image forming apparatus according to claim 17, wherein the power feeding roller is a metal roller made of metal.

20. The image forming apparatus according to claim 17, wherein the elastic layer contains a conducting agent.

21. An image forming apparatus, comprising:

a belt configured to bear a toner image;

a transfer roller comprising a conductive shaft and an elastic layer formed around the conductive shaft, the transfer roller forming a transfer nip where the transfer roller is in contact with an outer surface of the belt to transfer the toner image borne on the belt onto a recording medium;

an opposing roller disposed opposite to the transfer roller through the belt to form the transfer nip;

a conductive roller configured to rotate while in contact with an outer surface of the transfer roller;

a power source configured to supply transfer current flowing to a first area and a second area in a transferring period in which image is transferred to the recording medium by applying a transfer bias, the first area being an area between the opposing roller and the transfer roller, the second area being an area where the conductive roller is in contact with the transfer roller; and a controller configured to execute a cleaning mode in which the power source applies a cleaning bias to transfer toner adhering on the conductive roller to the belt through the transfer roller in a non-transferring period during which no image is transferred to the recording medium, wherein a cleaning period in which the cleaning mode is executed includes a first application period during which at least a first bias having polarity reverse to that of the transfer bias is applied by the power source and a second application period during which at least a second bias having a same polarity as that of the transfer bias is applied by the power source.

22. The image forming apparatus according to claim 21, wherein the first application period appears before the second application period in the cleaning mode.

23. The image forming apparatus according to claim 21, wherein the first application period and the second application period are respectively equal to or longer than a rotation time during which the transfer roller rotates one revolution.

24. The image forming apparatus according to claim 23, wherein the controller is configured to execute the cleaning mode such that the second application period continuously follows the first application period.

25. The image forming apparatus according to claim 21, wherein a duration of the first application period is shorter than that of the second application period.

26. The image forming apparatus according to claim 21, wherein the elastic layer contains a conducting agent.

27. The image forming apparatus according to claim 21, wherein the conductive roller is made of metal.

28. The image forming apparatus according to claim 21, wherein the controller is configured to execute the cleaning mode by repeating such a series of operations that the transfer roller rotates one revolution or more while applying the first bias and next the transfer roller rotates one revolution or more while applying the second bias.

29. The image forming apparatus according to claim 21, further comprising a belt cleaning unit configured to clean the belt by coming into contact with the belt.

30. The image forming apparatus according to claim 21, wherein the controller is configured to execute the cleaning mode in response to an occurrence of jamming of the recording medium.

31. The image forming apparatus according to claim 21, wherein the controller is configured to form a predetermined toner image passing through the transfer nip in the non-transferring period and execute the cleaning mode after the predetermined toner image passing through the transfer nip.

32. The image forming apparatus according to claim 21, wherein the first application period and the second application period are respectively corresponding to a rotation time during which the transfer roller rotates one revolution.

33. The image forming apparatus according to claim 21, wherein the power source is configured to apply the transfer bias to the conductive roller so that the transfer current flows from the conductive roller to the transfer roller and from the transfer roller to the opposing roller.

* * * * *